US006167219A

United States Patent [19]

Miyamoto et al.

[11] Patent Number: 6,167,219

[45] **Date of Patent: *Dec. 26, 2000**

[54] GROUNDING MEMBER, FLANGE, PHOTOSENSITIVE DRUM, PROCESS CARTRIDGE AND ELECTROPHOTOGRAPHIC IMAGE FORMING APPARATUS

[75] Inventors: Jun Miyamoto, Mishima; Shigeo Miyabe, Numazu; Kouji Miura, Mishima, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/261,954

[22] Filed: Mar. 3, 1999

[30] Foreign Application Priority Data

Mar. 3, 1998 [JP] Japan ..... 10-067894

[51] Int. Cl.[7] ..... G03G 15/00

[52] U.S. Cl. ..... 399/90; 399/117; 399/159

[58] Field of Search ..... 399/90, 159, 117, 399/111, 116; 174/51

[56] References Cited

U.S. PATENT DOCUMENTS

| | | | |
|---|---|---|---|
| 5,331,373 | 7/1994 | Nomura et al. | 399/111 |
| 5,452,056 | 9/1995 | Nomura et al. | 399/111 |
| 5,463,446 | 10/1995 | Watanabe et al. | 399/111 |
| 5,500,714 | 3/1996 | Yashiro et al. | 399/111 |
| 5,585,889 | 12/1996 | Shishido et al. | 399/113 |
| 5,617,579 | 4/1997 | Yashiro et al. | 399/114 |
| 5,640,650 | 6/1997 | Watanabe et al. | 399/117 |
| 5,729,792 | 3/1998 | Ikehara | 399/90 |
| 5,729,796 | 3/1998 | Miura et al. | 399/114 |
| 5,768,658 | 6/1998 | Watanabe et al. | 399/111 |
| 5,815,644 | 9/1998 | Nishiuwatoko et al. | 399/113 |
| 5,825,472 | 10/1998 | Araki et al. | 355/200 |
| 5,839,028 | 11/1998 | Nomura et al. | 399/109 |
| 5,845,173 | 12/1998 | Zogg et al. | 399/90 |
| 5,870,655 | 2/1999 | Nishiuwatoko et al. | 399/111 |
| 5,873,012 | 2/1999 | Miyabe et al. | 399/90 |
| 5,878,309 | 3/1999 | Nomura et al. | 399/111 |
| 5,878,310 | 3/1999 | Noda et al. | 399/117 |
| 5,893,006 | 4/1999 | Kanno et al. | 399/13 |
| 5,926,666 | 7/1999 | Miura et al. | 399/25 |
| 5,937,240 | 8/1999 | Kanno et al. | 399/111 |
| 5,943,527 | 8/1999 | Kashiwagi et al. | 399/90 |
| 5,943,529 | 8/1999 | Miyabe et al. | 399/111 |
| 5,946,531 | 8/1999 | Miura et al. | 399/111 |
| 5,950,047 | 9/1999 | Miyabe et al. | 399/111 |
| 5,966,567 | 10/1999 | Matsuzaki et al. | 399/111 |

FOREIGN PATENT DOCUMENTS

| | | |
|---|---|---|
| 5-072955 | 3/1993 | Japan . |
| 5-119682 | 5/1993 | Japan . |
| 5-297782 | 11/1993 | Japan . |

*Primary Examiner*—Sophia S. Chen
*Attorney, Agent, or Firm*—Fitzpatrick, Cella, Harper & Scinto

[57] ABSTRACT

An electrical grounding member for an electrophotographic photosensitive drum, includes a base plate; a hole formed in a substrate, for receiving a conduction shaft for supporting the electrophotographic photosensitive drum; a first contact portion provided in the base plate and elastically contactable to the conduction shaft; a second contact portion, provided in the base plate, for elastically contacting an inner surface of a cylinder of the electrophotographic photosensitive drum; a third contact portion, provided in the base plate, for elastically contacting an inner surface of a cylinder of the electrophotographic photosensitive drum. The second contact portion and third contact portion are disposed at symmetrical positions relative to each other with respect to a center line of a contact portion between the first contact portion and the conduction shaft.

32 Claims, 14 Drawing Sheets

GROUNDING MEMBER, FLANGE, PHOTOSENSITIVE DRUM, PROCESS CARTRIDGE AND ELECTROPHOTOGRAPHIC IMAGE FORMING APPARATUS

FIELD OF THE INVENTION AND RELATED ART

The present invention relates to an electrical grounding member, a flange using the same, an electrophotographic photosensitive drum using the flange, and a process cartridge using the flange and an electrophotographic, image forming apparatus usable with the process cartridge.

Here, the term "electrophotographic image forming apparatus" refers to an apparatus which forms images on a recording medium, using an electrophotographic image forming process. It includes an electrophotographic copying machine, an electrophotographic printer (for example, LED printer, laser beam printer), an electrophotographic facsimile machine, an electrophotographic word processor, and the like.

The term "process cartridge" refers to a cartridge having, as a unit, an electrophotographic photosensitive member, and charging means, developing means and cleaning means, which is detachably mountable to a main assembly of an image forming apparatus. It may include, as a unit an electrophotographic photosensitive member and at least one of charging means, developing means and cleaning means. It may include, as a unit developing means and an electrophotographic photosensitive member.

An image forming apparatus using electrophotographic process is known which is used with the process cartridge. This is advantageous in that the maintenance operation can be, in effect, carried out by the users thereof without expert service persons, and therefore, the operativity can be remarkably improved. Therefore, this type is now widely used.

In such an electrophotographic image forming apparatus, an electrically grounded member for grounding the photosensitive drum is provided at an end of the electrophotographic photosensitive drum, and the grounding member contacts to a conduction shaft in a main assembly of the electrophotographic image forming apparatus, thus electrically grounding the drum.

SUMMARY OF THE INVENTION

It is a principal object of the present invention to provide a further improvement in the prior art structure.

It is another object of the present invention to provide an electrical grounding member, a flange, an electrophotographic photosensitive drum using the flange, and a process cartridge an electrophotographic image forming apparatus, and a method of electric connection between a main assembly and an electrophotographic photosensitive drum wherein when the drum is mounted to the main assembly of the electrophotographic image forming apparatus, the drum can be assuredly grounded to the main assembly.

It is another object of the present invention to provide an electrical grounding member, a flange, an electrophotographic photosensitive drum using the flange, and a process cartridge and an electrophotographic image forming apparatus, wherein a grounding electric connection is assuredly established between a cylindrical member used for the image forming apparatus and and the main assembly of the image forming apparatus.

According to an aspect of the present invention, there is provided an electrical grounding member for an electrophotographic photosensitive drum, comprising a base plate; a hole, formed in a substrate, for receiving a conduction shaft for supporting the electrophotographic photosensitive drum; a first contact portion provided in the base plate and elastically contactable to the conduction shaft; a second contact portion, provided in the base plate, elastically contactable to an inner surface of a cylinder of the electrophotographic photosensitive drum; a third contact portion, provided in the base plate, elastically contactable to an inner surface of a cylinder of the electrophotographic photosensitive drum; wherein second contact portion and third contact portion are disposed at symmetrical positions relative to each other with respect to a center line of a contact portion between the first contact portion and the conduction shaft.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, preferred embodiments of the present invention will be described with reference to the drawings.

Figure 1:
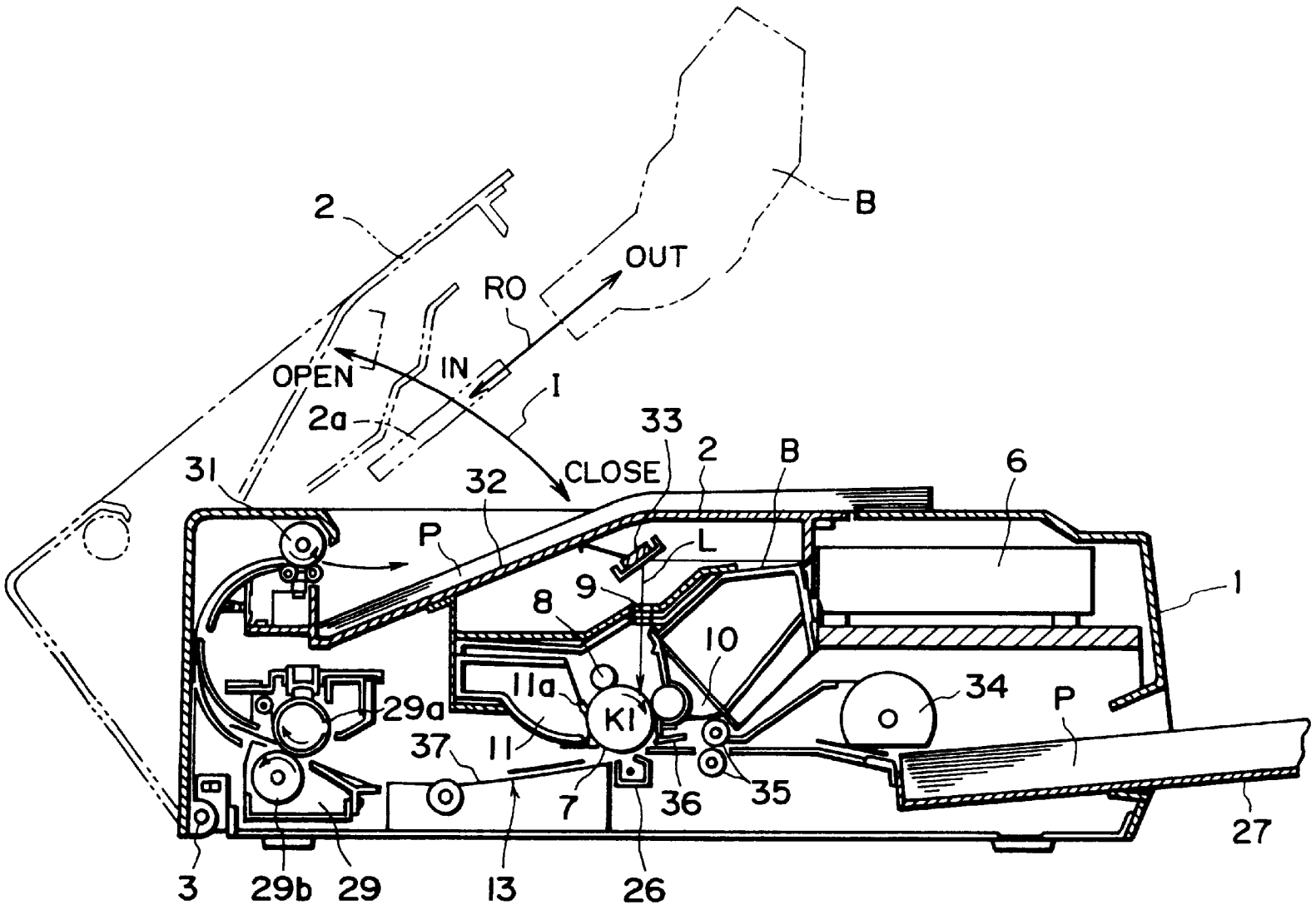
FIG. 1 is a longitudinal sectional view of an electrophotographic image forming apparatus using a process cartridge.

FIG. 1 schematically illustrates an electrophotographic image forming apparatus (printer) which employs a process cartridge in accordance with the present invention. This electrophotographic image forming apparatus (hereinafter, "image forming apparatus") is a laser beam printer, which is based on an electrophotographic process, and employs a removably installable process cartridge.

In other words, this image forming apparatus is constituted of the main assembly and a removably installable process cartridge. The main assembly comprises a structural frame constituted of two pieces: a top portion 2 and a bottom portion 1. The top portion 2 is hinged to the rear side (left side in FIG. 1) of the bottom portion 1 with the use of a hinge pin 3, so that it can be rotated in the direction indicated by an arrow mark (I), about the hinge pin 3 to enable it to take two positions: an open position (outlined by double dot chain line) and a closed position (outlined by solid line). When the top portion 2 is at the open position, a process cartridge B (which will be described later in detail) can be installed into, or removed from, the main assembly in the direction indicated by an arrow mark (RO). The top portion 2 is provided with a pair of guides 2*a* as an installation-removal means along which the process cartridge B is installed or removed in the arrow (RO) direction. The guide 2*a* is in the form of a long groove, whereas the cartridge frame 12 of the process cartridge B guided by the guide 2*a* is provided with a pair of guides (unillustrated) in the form of a tongue, which fit in the pair of guides 2*a*, one for one. The cartridge frame 12 will be described later in detail.

As the top portion 2 of the structural frame of the apparatus main assembly is closed, the process cartridge B is placed at a predetermined position in the main assembly. With the process cartridge B at the predetermined position in the main assembly, a laser scanner unit 6, which constitutes the main portion of an exposing apparatus, is located on the front side (right-hand side in FIG. 1) of the process cartridge B, and a sheet cassette 27, in which a plurality of sheets P, that is, image media, are held, is located below the process cartridge B. On the downstream side of the sheet cassette 27 in terms of the direction in which the sheet P is conveyed, a sheet feeder roller 34, a registration roller pair 35, a transfer guide 36, a transfer charger 26 as a transferring means, a sheet conveyer 37, a fixing device 29, and the like are arranged in the listed order. These components are all disposed in the bottom portion 1 of the structural frame of the main assembly, whereas a sheet discharge roller 31, a delivery tray 32, and d reflection mirror 33, which are on the downstream side of the fixing device 29 are disposed, along with the process cartridge B, in the top portion 2 of the structural frame of the main assembly.

In this embodiment, the sheet feeder roller 34, registration roller pair 35, transfer guide 36, sheet conveyer 37, sheet discharge roller 31, and the like constitute a conveying means 13 for conveying the sheet P as a recording medium.

Figure 2:
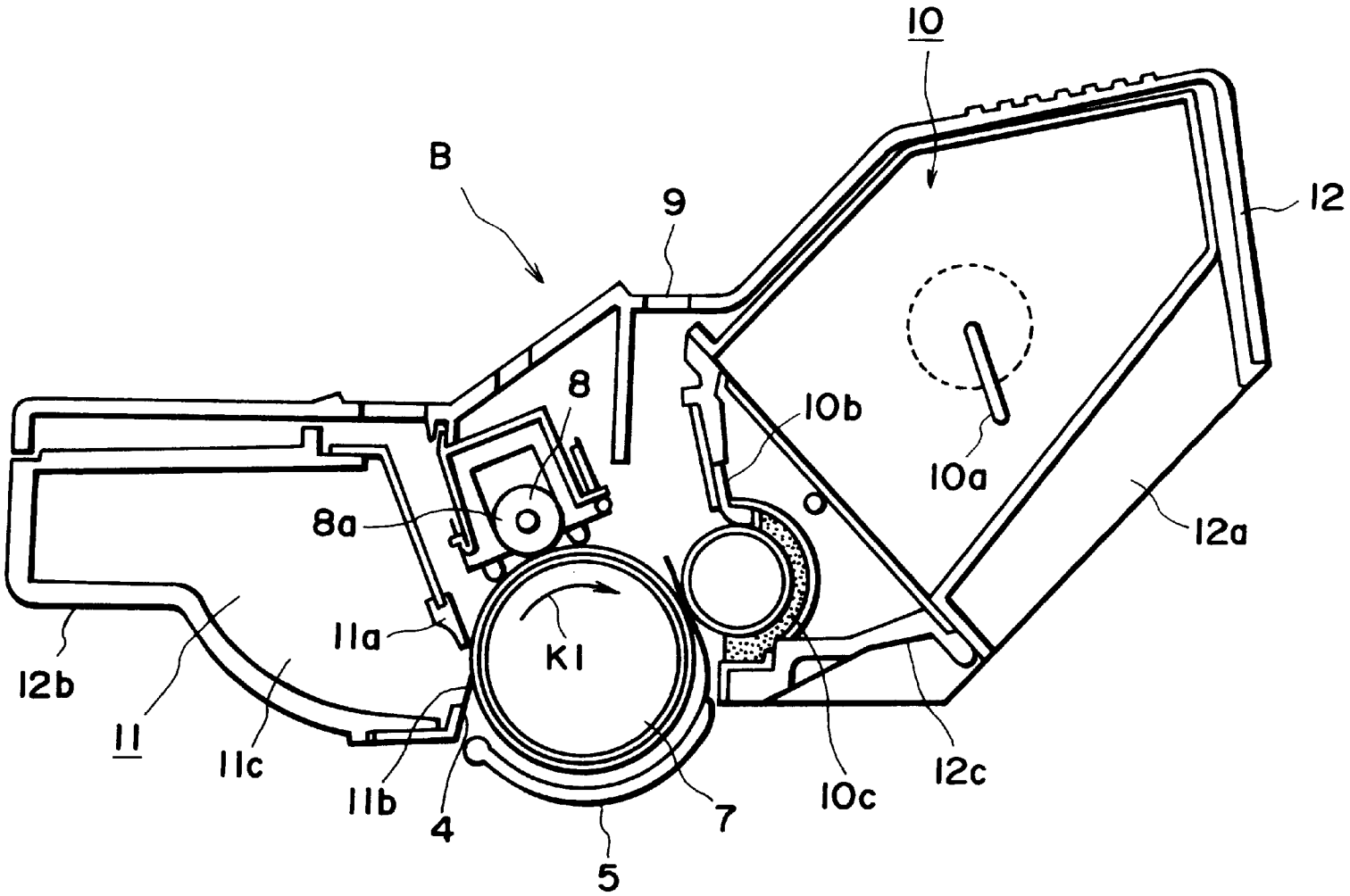
FIG. 2 is a longitudinal sectional view of a process cartridge usable with the electrophotographic image forming apparatus shown in FIG. 1.

Referring to FIG. 2, the process cartridge B comprises a structural frame 12 constituted of a toner frame 12*a*, a cleaning frame 12*b*, and a development frame 12*c*. The toner frame 12*a* stores toner. The development frame 12*c* is attached to the toner frame 12*a*, and the cleaning frame 12*b* is attached to the development frame 12*c*. This cartridge frame 12 integrally contains four processing devices: a photosensitive drum (electrophotographic photosensitive member) 7, a charging means 8, a developing means 10, and a cleaning means 11. The photosensitive drum 7 is a rotative cylindrical member, and the charging member 8 comprises a rotative roller 8*a*. The developing means 10 rotatively supports a development roller 10*c*, and the cleaning means 11 comprises a cleaning blade 11*a* and a waste toner bin 11*c*. The top wall of the cartridge frame 12 is provided with an exposure window 9, which is formed by cutting or drilling. The bottom wall of the cartridge frame 12 is provided with a cover 5, which can be opened to expose, or closed to cover, the opening 4 through which an image formed on the photosensitive drum 7 is transferred onto recording medium. The cover 5 moves to the closed position to cover the opening 4, protecting the photosensitive peripheral surface of the photosensitive member 7 as the process cartridge B is removed from the main assembly of the printer (electrophotographic image forming apparatus), or the top portion 2 of the structure frame of the main assembly is opened.

Next, an image forming process will described in general terms. Upon reception of a process start signal, the photosensitive drum 7 is rotatively driven in the direction indicated by an arrow mark K1 at a predetermined peripheral velocity (process speed). The peripheral surface of the photosensitive drum 7 is in contact with the charge roller 8*a* of the charging means 8, to which bias voltage is applied. Thus, as the photosensitive drum 7 is rotatively driven, the peripheral surface of the photosensitive drum 7 is uniformly charged by this charging means 8.

From the laser scanner unit 6, a laser beam L, modulated with sequential digital electric signals which reflect image data, is outputted. The laser beam L is reflected by the reflection mirror 33, and enters the cartridge frame 12 through the exposure window 9 of the top wall of the cartridge frame 12, exposing the charged peripheral surface of the photosensitive drum 7 in a scanning manner. As a result, an electrostatic latent image which reflects the image data is formed on the peripheral surface of the photosensitive drum 7. This electrostatic latent image is developed by a layer of developer (toner) coated on the peripheral surface of the development roller 10*c*. The thickness of the layer of the toner is regulated by the development blade 10*b* of the developing means 10. The toner is sent from the toner frame 12*a* into the development frame 12*c* by the toner sending member 10*a* disposed in the toner frame 12*a*.

Meanwhile, the plurality of sheets P stored in the sheet cassette 27 are sent out, one by one, from the sheet cassette 27 by the sheet feeder roller 34. Then, the sheet P is delivered to the transfer station, that is, the interface between the peripheral surfaces of the photosensitive drum 7 and transfer charger 26, by the registration roller pair 35, through the transfer guide 36, with a timing coordinated with the timing for the outputting of the laser beam L. In the transfer station, the toner image on the photosensitive drum 7 is transferred onto the sheet P starting from the downstream end.

After the toner image is transferred onto the sheet P, the sheet P is separated from the photosensitive drum 7, and then is conveyed to the fixing device 29 by the sheet conveyer 37. In the fixing device 29, the sheet P is put through the nip formed by the fixing roller 29*a* and pressure roller 29*b*.

While the sheet P is put through the nip, the toner image is fixed to the sheet P. Then, the sheet P with the fixed toner image is discharged into the delivery tray 32 by the sheet discharge roller 31. After the image transfer, the photosensitive drum 7 is cleaned by the cleaning means; the toner particles remaining on the peripheral surface of the photosensitive drum 7 are removed by the cleaning blade 11*a* of the cleaning means 11. The removed toner particles are guided into the waste toner bin 11*c* by a scooping sheet 11*b*. Thereafter, the cleaned portion of the peripheral surface of the photosensitive drum 7 is used for the next cycle of the image forming process which starts from the charging of the photosensitive drum 7.

Supporting Structure for Photosensitive Drum 7

Figure 3:
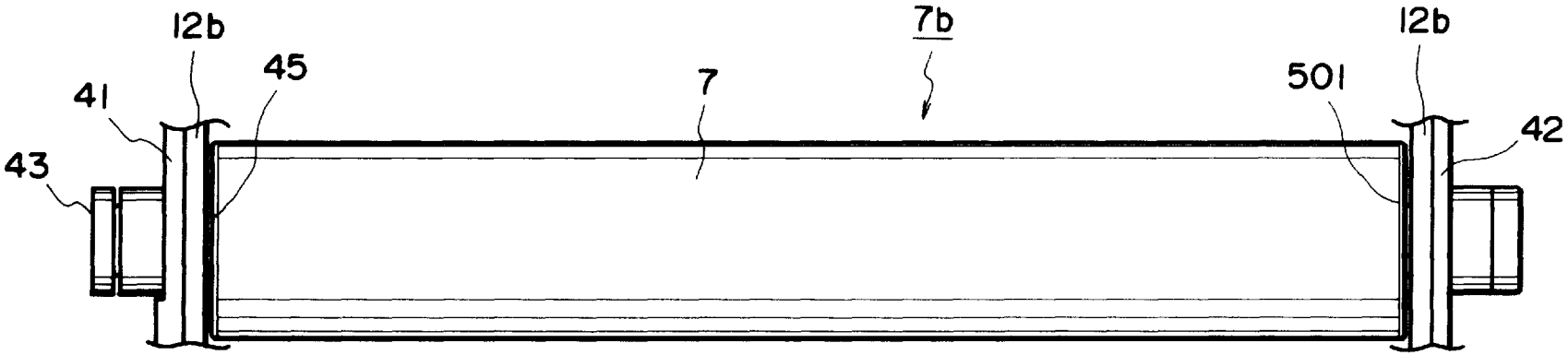
FIG. 3 is a side view illustrating a supporting structure for a photosensitive drum.

FIG. 3 is a side view of the structure for supporting the photosensitive drum 7.

Referring to FIG. 3, reference characters 7*b* and 7 designate a drum unit and a photosensitive drum 7, respectively. A reference character 45 designates a drum flange assembly, which is attached to one of the longitudinal ends, that is, the driving side end, of the photosensitive drum 7 (cylindrical drum 600), by crimping or the like method.

A reference character 41 designates a cover member of the cleaning frame 12*b*, which is located on the driving side. A reference character 43 designates a means for transmitting a driving force, which is constituted of a certain type of coupler. This driving force transmitting means 43 is engaged with an unillustrated axial member fixed to the drum flange 45 by insert molding or the like method, and transmits the driving force from the printer main assembly to rotate the photosensitive drum 7.

A reference character 501 designates a drum flange assembly attached to the other end, that is, the end opposite to the driving end, of the photosensitive drum 7. A reference character 50 designates the drum flange of the drum flange assembly 501, and a reference character 42 designates the cover of the cleaning frame 12*b*, on the side opposite to the driving side.

The drum unit 7*b* comprises the photosensitive drum 7 and drum flange assemblies 45 and 501.

Structure of Drum Unit 7*b*

Figure 4:
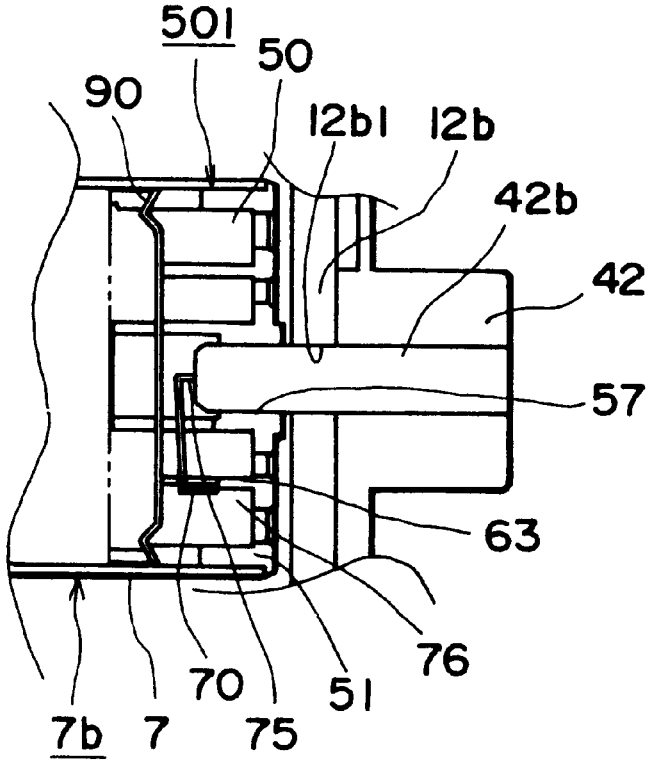
FIG. 4 is a sectional view of a drum flange at a non-driving side of a drum unit.

FIG. 4 is sectional view of one of the longitudinal end portions of the drum unit 7*b*, on the side opposite to the driving side, adjacent to the drum flange assembly 501.

In FIG. 4, a reference character 42*b* designates an electrically conductive axial shaft as the central axis, which is fixed to the cover 42 on the side opposite to the driving side by insert molding or a like method. It is made of steel, being formed by turning, and is plated with nickel.

The electrically conductive shaft 42*b*, which is the axial member, is put through a hole 12*b*1 of the cleaning frame 12*b*, so that it doubles as the member which fixes the positional relationship between the cleaning frame 12*b* and the photosensitive drum 7.

A reference character 70 designates a plate for grounding the photosensitive drum 7. This drum grounding member 70 is attached to the drum flange 50 of the drum flange assembly 501 with the use of an anchoring or clamping plate 90 constituted of a piece of elastic plate, being pinched between the drum flange 50 of the drum flange assembly 501 and the clamping plate 90.

The drum grounding plate 70 is provided with an elastic arm portion 75, or the first springy arm portion, which will be described later. It is electrically connected to the electrically conductive shaft 42*b*, and grounds the photosensitive drum 7 through the ground contact portions 73*a* and 73*b* of cylinder contact springs 77*a* and 77*b* as the second plate springs, which also will be described later.

Structure of Drum Flange 50 of Drum Flange Assembly 501

Figure 5:
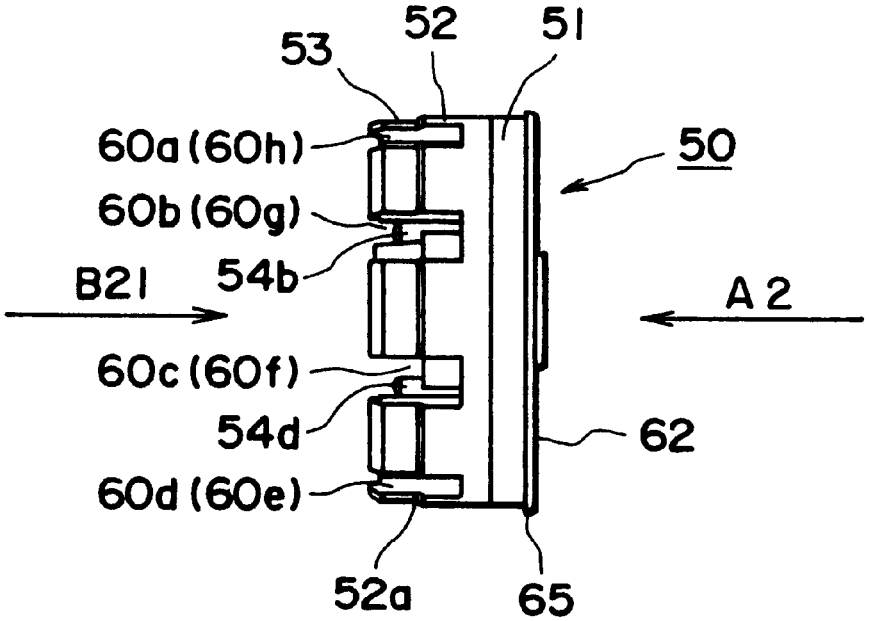
FIG. 5 is a side view of a body of the drum flange.

FIG. 5 is a side view of the drum flange 50 of the drum flange assembly 501 illustrated in FIG. 4.

The drum flange 50 of the drum flange assembly 501 is formed of resin. Its peripheral wall portion comprises a stopper portion 65, and a portion 51, a portion 52, and a guide portion 53, which are to be fitted into the photosensitive drum 7. The stopper portion 65 is a portion which fixes the positional relation between the drum flange 50 and the photosensitive drum 7 in the longitudinal direction of the photosensitive drum 7. The fitting portion 51 is a portion which is pressed into the photosensitive drum 7, and the fitting portion 52, or the second portion, is a portion which also is pressed into the photosensitive drum 7. The pressure applied to the portion 52 to fit it into the photosensitive drum 7 is lighter than the pressure applied to the portion 51 to insert it into the photosensitive drum 7. The insert guide portion 53 is a portion which is fitted into the photosensitive drum 7, perfectly or with some play.

Figure 19:
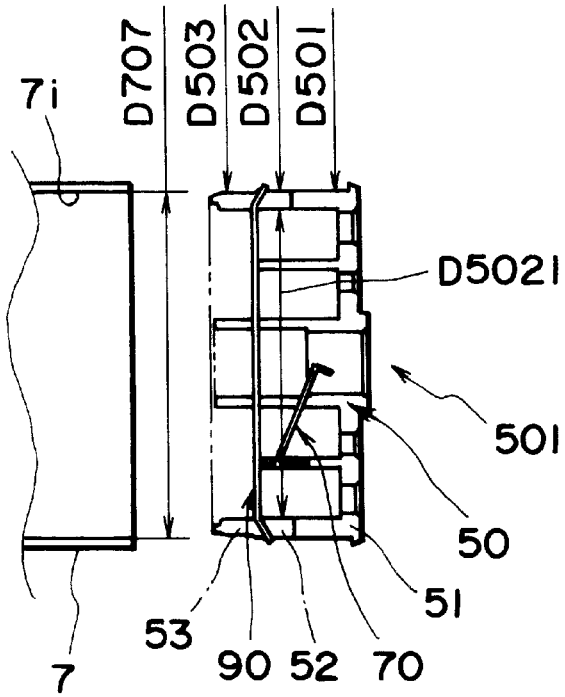
FIG. 19 is an illustration of the relation between the diameters of the drum flange and the photosensitive drum.

Referring to FIG. 19, the external diameter D501 of the fitting portion 51 is 1.0005 to 1.005 times the internal diameter D707 of the photosensitive drum 7. The external diameter D502 of the fitting portion 52 is 0.999 to 1.002 times the internal diameter D707 of the photosensitive drum 7. The external diameter D503 of the fitting guide portion 53 is exactly matched to the internal diameter D707 of the photosensitive drum 7 so that it perfectly fits into the photosensitive drum 7, that is, without leaving any gap.

The fitting portion 52 is provided with an edge portion 52*a*, which is located on the fitting guide portion 53 side. The edge portion 52*a* is constituted of a rib which circles the peripheral surface of the drum flange 50. It projects 0.5 mm to 3 mm in the radial direction of the drum flange 50. The internal diameter D502 of the fitting portion 52 is smaller than the diameter D902 of the circumcircle of the flange gripping extensions 92*a*–92*h*.

Figure 6:
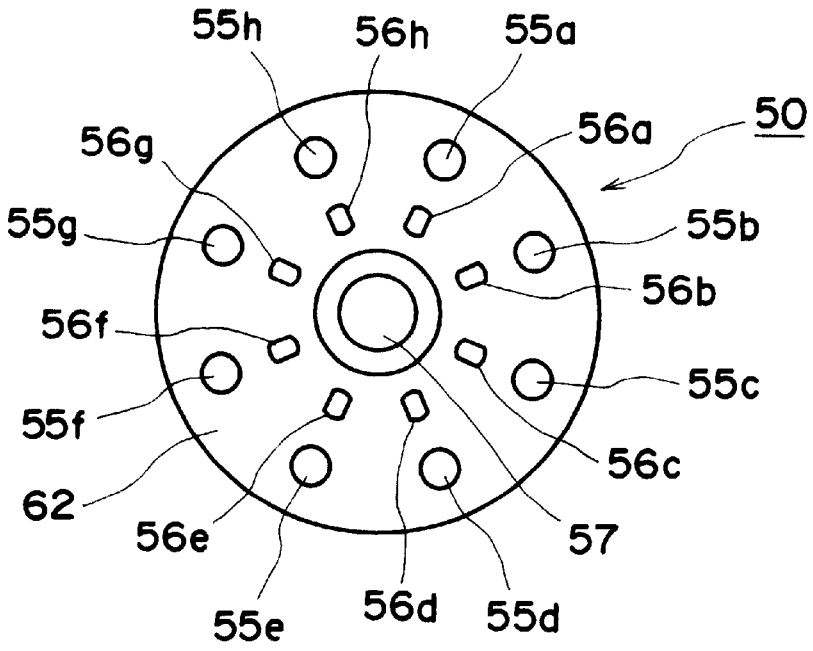
FIG. 6 is a rear view of a body of the drum flange.

FIG. 6 is an illustration of the drum flange 50 as seen from the direction indicated by an arrow mark A2 in FIG. 5.

In FIG. 6, reference characters 55*a*–55*h* designate through holes for a pressing tool 631 for pressing the cylinder gripping extensions or cylinder clamping pawls 91*a*–91*h* of the clamping plate 90. Reference characters 56*a*–56*h* designate holes with which the circular flat wall 62 of the drum flange 50 is provided for positioning the pressing tool 631 in terms of the rotational direction of the photosensitive drum 7; the pressing tool 631 is accurately positioned relative to the drum flange 50 by the holes 56*a*–56*h*, assuring that the clamping plate 90 is pressed, on the correct points 99.

A reference character 57 designates a hole through which the electrically conductive shaft 42*b* is put, as tightly as possible while allowing the photosensitive drum 7 to rotate about the shaft 42*b*.

Figure 7:
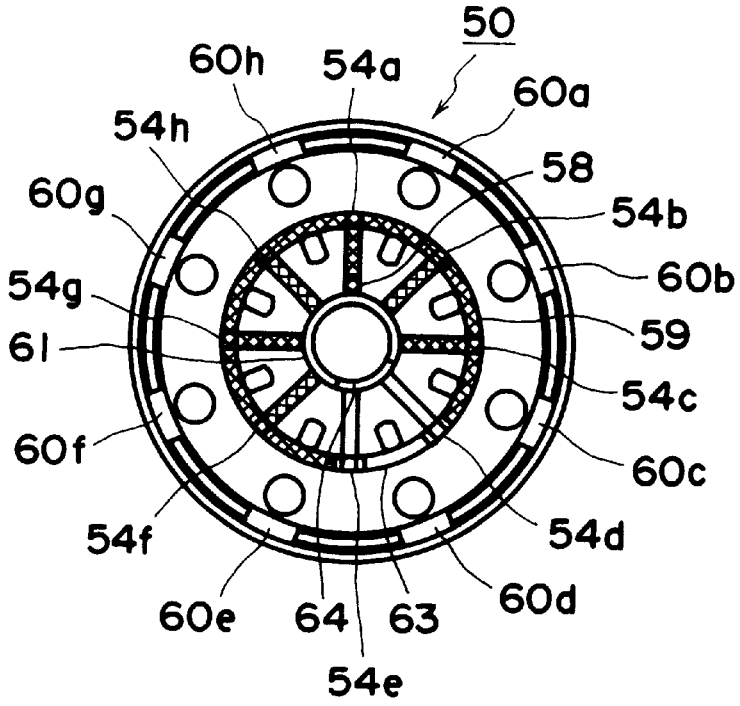
FIG. 7 is a front view of the body of the drum flange.

FIG. 7 is a front view of the drum flange 50 of the drum flange assembly 501 illustrated in FIG. 4 as seen from the direction indicated by an arrow mark B21 in FIG. 5.

In FIG. 7, a reference character 58 designates a rectangular boss which accurately fixes the positional relationship between the drum grounding plate 70 and the clamping plate 90 in terms of the rotational direction of the photosensitive drum 7. In other words, with the presence of this boss 58, the pressing tool 631 is accurately aligned with the cylinder gripping rectangular radial extensions 91*a*–91*h* of the clamping plate 90, assuring that the correct points 99 of the clamping plate 90 are pressed.

A reference character 59 designates the inward end surface of the drum flange 50, or the hatched portion in the drawing. This is the surface to which the drum grounding plate 70 is attached. It is precisely formed.

Reference characters 54*a*–54*h* designate bosses for holding the drum grounding plate 70 and clamping plate 90 to the drum flange 50. They are melted after these plates 70 and 90 are mounted.

Reference characters 60*a*–60*h* designate slots cut in the fitting portion 52 and fitting guide portion 53 of the drum flange 50. As described before, the elastic contact portions 73*a* and 73*b* of the grounding plate 70, and the rectangular, radial, cylinder clamping pawls 91*a*–91*h* of the clamping plate 90, are put through these slots, being placed in contact with the inside surface 7*i* of the photosensitive drum 7.

A reference character 61 designates a cylindrical boss for centering the drum grounding plate 70 and clamping plate 90 relative to the drum flange 50. This boss 61 makes it possible for the eight cylinder clamping pawls 91*a*–91*h* of the clamping plate 90 to make contact with the inside surface 7*i* of the photosensitive drum 7, on the predetermined points, with uniform pressure.

A reference character 64 designates a slot for the elastic shaft contact arm portion 75 of the drum grounding plate 70. The slot 64 affords the elastic arm portion 75 of the drum grounding plate 70 a sufficient stroke range, so that an accurate amount of pressure is generated by the elastic shaft contact portion 75.

A reference character 63 designates a rib, which presses down on the drum grounding plate 70, engaging with the bend portion 76 of the drum grounding plate 70. The bend portion 76 will be described later More specifically, the rib 63 presses down on the end portion of the bend portion 76 of the drum grounding plate 70, assuring that a proper amount of pressure is applied to the electrically conductive shaft 42*b* by the elastic arm portion 75 of the drum grounding plate 70, and therefore assuring electrical conductivity.

Structure of Drum Grounding Plate 70

Figure 8:
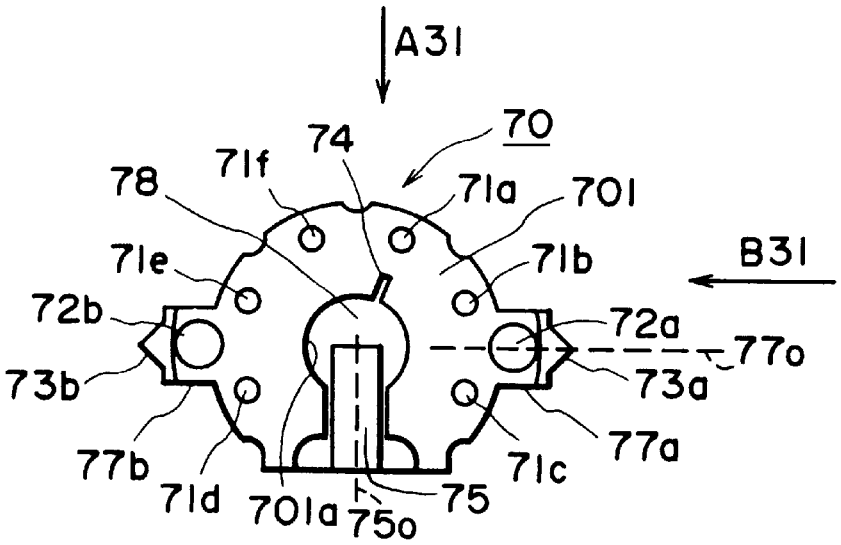
FIG. 8 is a front view of a drum grounding plate.

FIG. 8 is a front view of the drum grounding plate 70.

The drum grounding plate 70 is formed of phosphor bronze or the like, which is electrically conductive and also elastic. It comprises the first elastic contact portions 75*a*, and the second elastic contact portions 73*a* and 73*b*, which will be described later. The first elastic contact portion 75*a* makes contact with the electrically conductive shaft 42*b* of the cover 42, which is placed in contact with the ground portion (unillustrated) of the printer main assembly. The second contact portions 73*a* and 73*b* are placed in contact with the inside surface 7*i* of the photosensitive drum 7. With the presence of the above described structure, the photosensitive drum 7 is grounded to the ground portion of the printer main assembly.

The contact portion 75*a* is provided at the end of the elastic arm portion 75 of the drum grounding plate 70 (FIGS. 9 and 10), and the second contact portions 73*a* and 73*b* are provided at the end portions of the cylinder springs 77*a* and 77*b*, respectively. The first contact portion 75*a* and the second contact portions 73*a* and 73*b* are angularly shaped.

The springs 77*a* and 77*b* are identically shaped, and are symmetrically positioned relative to the center line (75*o*) of the elastic arm portion 75 of the drum grounding plate 70, that is, a line drawn through the point of contact between the contact portion 75*a* and the electrically conducive shaft 42*b* and the center of the elastic arm portion 75.

Reference characters 72*a* and 72*b* designate through holes, which are cut through the springs 77*a* and 77*b*. Cutting these holes 72*a* and 72*b* through the spring portions 77*a* and 77*b* reduces the widths of the spring portions 72*a* and 72*b* in terms of material, reducing thereby their resiliency, without reducing the widths of the spring portions 72*a* and 72*b* in terms of structure, maintaining thereby virtually the same structural strength as that provided when no hole is cut.

Reference characters 71*a*–71*f* designate holes, through which the aforementioned thermally deformable bosses 54*a*–54*f* are put, one for one; they are aligned in a circle, which has the same center and diameter as those of the circle in which the thermally deformable bosses 54*a*–54*h* of the drum flange 50 are aligned, and also are aligned with the same pitch as those bosses. The holes 71*b* and 71*c* are symmetrically positioned with respect to each other relative to the center line 77*o*1 of the spring portion 77*a*, and the holes 71*d* and 71*e* are symmetrically positioned with respect to each other relative to the center line of the spring portion 77*b*. The thermally deformable bosses 54*b*, 54*c*, 54*f* and 54*g* are put through these holes 71*b*, 71*c*, 71*d* and 71*e*, one for one in the listed order, and then, are melted to hold the drum grounding plate 70 to the drum flange 50. As a result, it is assured that pressure is uniformly applied to the spring portions 77*a* and 77*b* by the two pairs of deformed bosses 54*b*, 54*c*, 54*f* and 54*g*. The above arrangement assures that the drum grounding plate 70 remains correctly positioned relative to the drum flange assembly 501 when the drum flange assembly 501 is inserted into the photosensitive drum 7, and that the spring portions 77*a* and 77*b* are prevented from being easily twisted.

The contact portions 73*a* and 73*b* of the 701 are angularly shaped as described before, and therefore, the angular tips and finned edges of the contact portions 73*a* and 73*b* assure that sufficient electrical conductivity is maintained between the inside surface 7*i* of the photosensitive drum 7 and the contact portions 73*a* and 73*b*.

A reference character 74 designates a slot for fixing the position of the drum grounding plate 70 relative to the drum flange 50 in terms of the rotational direction of the photosensitive drum 7. The slot 74 engages with the rectangular positioning boss 58 to fix the angle of the drum grounding plate 70 relative to the drum flange 50.

Figure 9:
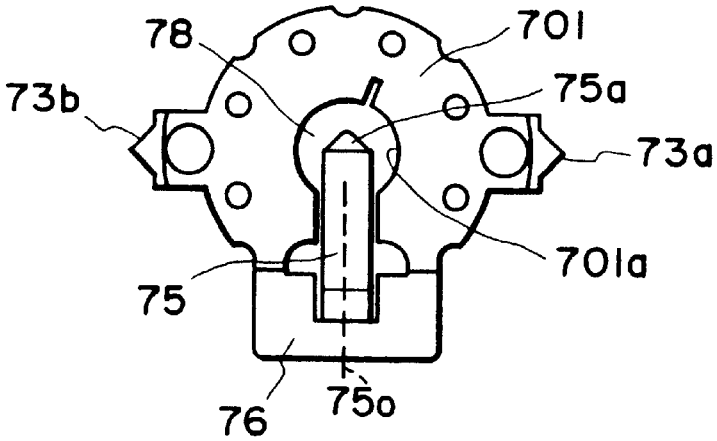
FIG. 9 is a front view of a drum grounding plate before shaping.

FIG. 9 is a development of the drum grounding plate 70. The drum grounding plate 70 is constituted of a single piece of an approximately 0.2 mm thick metallic plate. As for the manufacturing method for the drum grounding plate 70, a pressing or the like method is used so that a strong drum grounding plate with high strength can be economically manufactured.

Figure 10:
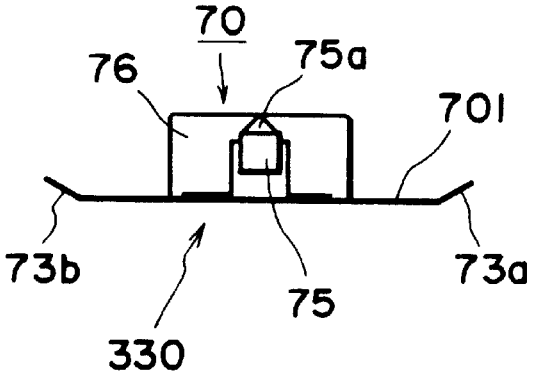
FIG. 10 is a top plan view of a drum grounding plate.

FIG. 10 is a top view of the drum grounding plate 70 as seen from the direction indicated by an arrow mark A31 in FIG. 8.

Referring to FIG. 9, the drum grounding plate 70 is a single piece of a metallic plate formed by pressing or the like method as described above. It is constituted of a portion 701, which is flat and substantially round, and a smaller portion 76, which extends almost perpendicularly from the flat and round portion 701. The flat and round portion 701 is provided with a hole 78, through which the electrically conductive shaft 42*b* is put, and the slot 701*a*. It is placed flatly in contact with the drum flange 50. The perpendicular smaller portion 76 is provided with the elastic arm portion 75, which is tilted toward the flat and round main portion 701*a* so that it makes contact with the electrically conductive shaft 42*b*. The smaller portion 76, substantially perpendicular to the flat and round main portion 701, also makes contact with the rib 63 of the drum flange 50, assuring that the elastic arm portion 75 of the drum grounding plate 70 generates a contact pressure of 50 g to 100 g.

With the above described arrangement, it is possible to provide the drum grounding plate 70 with a longer elastic arm portion 75, which has a smaller constant of elasticity.

The drum grounding plate 70 is formed by pressing so that the fins are created on the side 330 indicated by an arrow mark 330. Therefore, the drum grounding plate 70 makes contact with the inside surface 7*i* of the photosensitive drum 7, by the finned side of the edge, assuring reliable contact.

Figure 11:
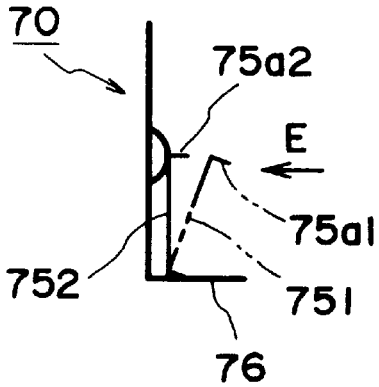
FIG. 11 is a side view of a drum grounding plate.

FIG. 11 is side view of the drum grounding plate 70 as seen from the direction indicated by an arrow mark B31 in FIG. 4.

As the drum unit 7*b* is assembled into the structural frame of the process cartridge B, the elastic arm portion 75 for the first contact point 75*a* is pressed in the direction indicated by an arrow mark E by the electrically conductive shaft 42*b*, being elastically bent from the position outlined by a double dot chain line 751 to the position outlined by the solid line 752, causing the contact point 75*a* to come in contact with the electrically conductive shaft 42*b*. The contact point 75*a* placed in contact with the electrically conductive shaft 42*b* is kept in contact with the shaft 42*b* by the resiliency of the elastic arm portion 75 while being allowed to slide on the peripheral surface of the shaft 42*b*. When the elastic arm portion 75 is at the position outlined by the solid line 752, the contact point 75*a* is at a position 75*a*2, having been moved from a position 75*a*1 at which it was before the elastic arm portion 75 was pressed by the electrically conductive shaft 42*b*. Thus, after the assembly, the contact point 75*a* remains in contact with the rotational center portion of the electrically conductive shaft 42*b*, and yet, it is prevented from being easily worn by friction.

Structure of Clamping Plate 90

Figure 12:
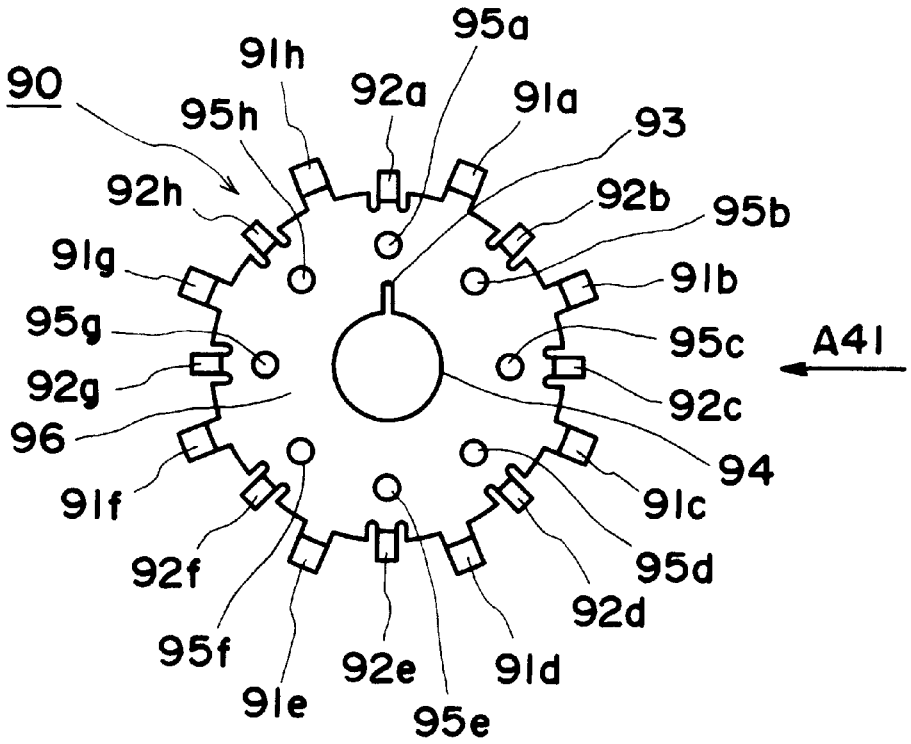
FIG. 12 is a front view of a clamping plate.

FIG. 12 is a front view of the clamping plate 90 as a means for clamping the drum flange 50 to the photosensitive member 7.

The clamping plate 90 is a plate-like member formed of an approximately 0.1 mm–0.5 mm thick plate of SUS (stainless steel), phosphor bronze, or the like material.

Here, an clamping plate 90 formed of 0.2 mm thick SUS304P will be described as an example.

In FIG. 12, reference characters 91*a*–91*h* are radial rectangular, cylinder clamping pawls of the clamping plate 90 as the second extensions. As the drum flange assembly 501 is inserted into the photosensitive drum 7 after the clamping plate 90 is attached to the drum flange 50, the extensions 91*a*–91*h* come in contact with the inside surface 7*i* of the photosensitive drum 7, and firmly anchor themselves to the inside surface 7*i*. The extensions 91*a*–91*h* are tilted toward the bottom end surface 62 of the drum flange 50 so that it becomes easier for the clamping plate 90 to be inserted into the photosensitive drum 7. Further, tilting the extensions 91*a*–91*h* as described above causes them to bite into the inside surface 7*i* of the photosensitive drum 7 as a force is applied to the clamping plate 90 in the direction to push the drum flange assembly 501 out of the photosensitive drum 7. Therefore, the clamping plate 90 is prevented from easily coming out of the photosensitive drum 7. The diameter D901 (FIG. 13) of the circumcircle of the extensions 91*a*–91*h* is made to be 1.01–1.05 times the internal diameter D707 (FIG. 19) of the photosensitive drum 7, assuring that a sufficient amount of force is generated to cause the extensions 91*a*–91*h* to come in contact with the inside surface 7*i* of the photosensitive drum 7, and anchor themselves to the inside surface 7*i*.

The tip of each of the cylinder clamping pawls 91*a*–91*h* is shaped square, and makes contact with the inside surface 7*i* of the photosensitive drum 7 across its entire edge. In other words, the tip of each extension makes contact with the inside surface 7*i* of the photosensitive drum 7, across the wide area of the surface 7*i*, preventing thereby the cylinder from deteriorating in terms of circularity. Further, the extensions 91*a*–91*h* cause the coating on the inside surface 7*i* of the photosensitive drum 7 to be stripped across the wide area.

Reference characters 92*a*–92*h* designate the first rectangular, radial, drum flange clamping pawls of the clamping plate 90. The extensions 92*a*–92*h* make contact with the inside surface of the fitting portion 52 of the drum flange 50. They are tilted in a direction opposite to the tilt of the cylinder clamping pawl 91*a*–91*h*. This makes it easier for the clamping plate 90 to be inserted into the drum flange 50, while making it difficult for the clamping plate 90 to come out of the drum flange 50.

A reference character 93 designates a slot, which engages with the square boss 58 of the drum flange 50; engagement between the slot 93 and the boss 58 fixes the positional relationship between the drum flange 50 and the clamping plate 90 in terms of the rotational direction of the photosensitive drum 7. This makes it possible to accurately align the cylinder clamping pawls 91*a*–91*h* with the through holes 55*a*–55*h* for the pressing tool 631. Therefore, each cylinder clamping pawl 91*a*–91*h* can be pressed, on the precise spot, which will be described later. Further, the cylinder clamping pawl 91*a*–91*h* press themselves upon the inside surface 7*i* of the photosensitive drum 7 in a direction perpendicular to the inside surface 7*i*, anchoring themselves to the photosensitive drum 7 with the maximum effectiveness. Designated by reference numeral 94 is a hole through which the drum shaft passes.

Reference characters 95*a*–95*h* designate holes for the thermally deformable bosses 54*a*–54*h*. The holes 95*a*–95*h* are aligned in a circle with the same diameter as the circle in which the thermally deformable bosses 54*a*–54*h* are aligned, at the same pitch as the pitch at which the thermally deformable bosses 54*a*–54*h* are aligned.

Figure 13:
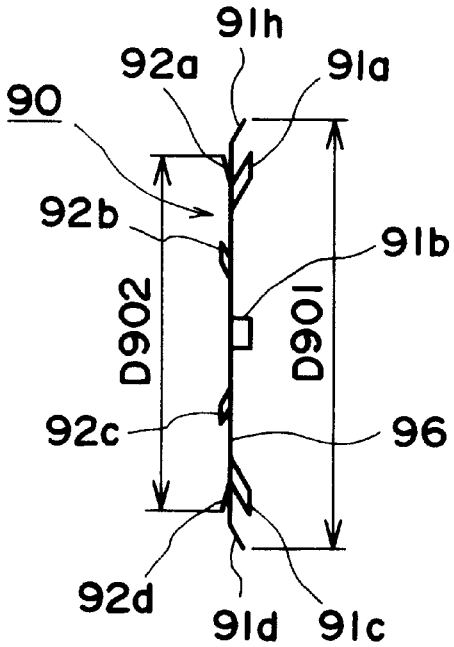
FIG. 13 is a side view of a clamping plate.

FIG. 13 is a side view of the clamping plate 90 as seen from the direction indicated by an arrow mark A41 in FIG. 12.

As illustrated in FIG. 13, the cylinder clamping pawls 91*a*–91*h* and the drum flange clamping pawl 92*a*–92*h* are tilted in the opposite directions. When the clamping plate 90 is assembled onto the drum flange 50, the clamping plate 90 is lined up so that the extensions 91*a*–91*h* tilt toward the circular inside surface 62 of the drum flange 50.

A reference character 96 designates the flat portion of the clamping plate 90. When the clamping plate 90 is assembled onto the drum flange 50, this flat portion 96 is placed in contact with the flat portion of the drum grounding plate 70, and then, the bosses 54*a*–54*h* are thermally deformed to retain the clamping plate 90. The flat portion 96 minimizes the deformation of the drum grounding plate 70 which occurs when the drum flange assembly 501 is inserted into the photosensitive drum 7.

Figure 14:
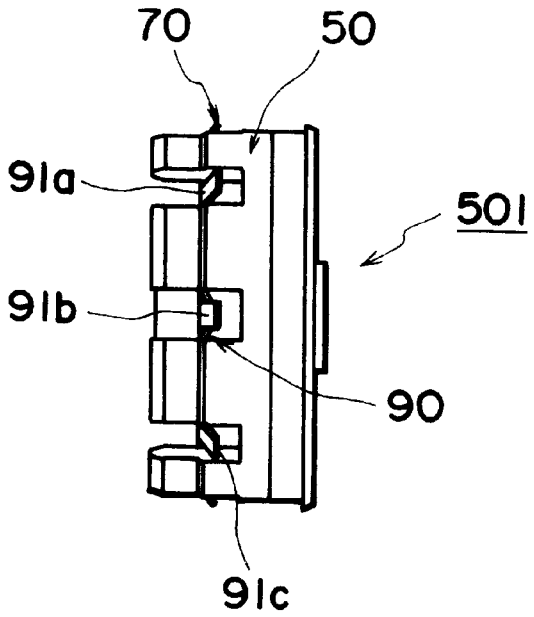
FIG. 14 is a side view of a drum flange.

FIG. 14 is a side view of the drum flange assembly 501.

The drum flange assembly 501 is constituted of the drum flange 50, which has been described so far, the drum grounding plate 70, and the clamping plate 90.

The clamping plate 90 is attached to drum flange 50 so that the extension 91*a*–91*h* tilt toward the circular inside surface 62 of the drum flange 50.

Lining up the clamping plate 90 as described above makes it easier to insert the drum flange assembly 501 into the photosensitive drum 7.

Internal Structure of Drum Flange Assembly 501

Figure 15:
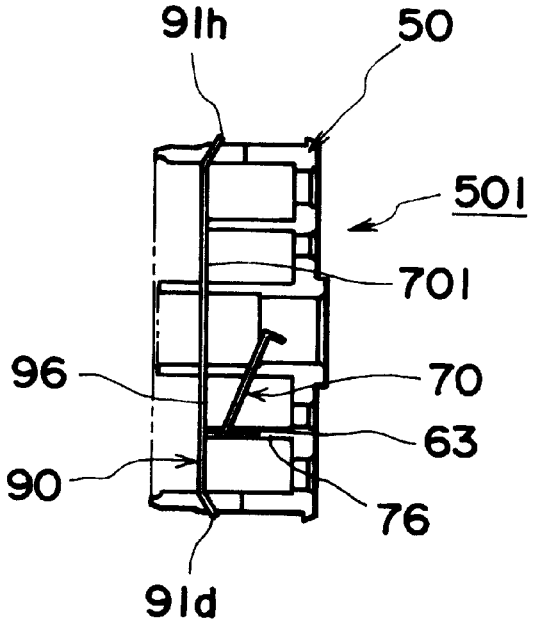
FIG. 15 is a sectional view of a drum flange.

FIG. 15 is a sectional view of the drum flange assembly 501 illustrated in FIG. 14.

The drum grounding plate 70 is attached to the drum flange 50 so that the bosses 54*a*–54*f* (unillustrated) are put through the holes 71*a*–71*f* (unillustrated) of the drum grounding plate 70, one for one. Then, the clamping plate 90 is attached to the drum flange 50, through the drum grounding plate 70.

Figure 16:
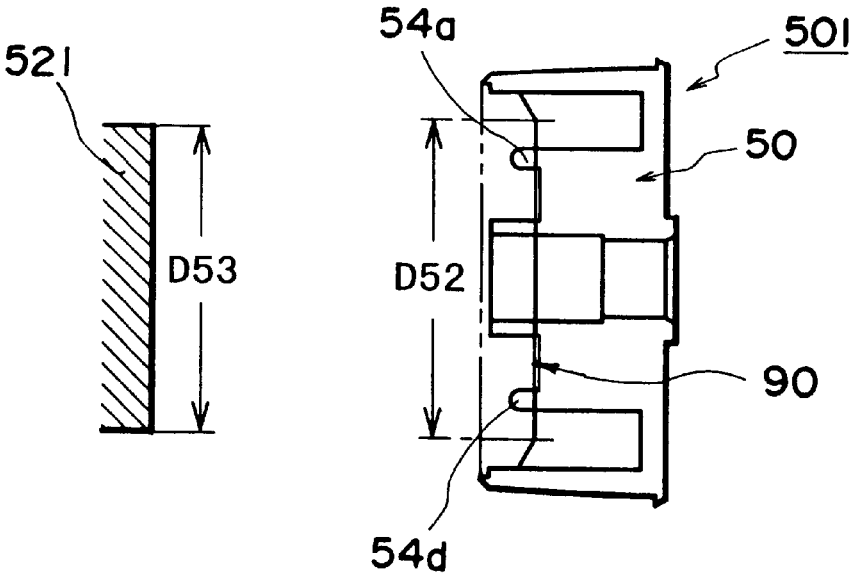
FIG. 16 is an illustration illustrating a mounting method of the drum flange to the main body.

FIG. 16 is a drawing which depicts how the clamping plate 90 is attached to the drum flange 50.

As depicted by FIG. 16, the clamping plate 90 is pressed into the drum flange 50 with the use of the pressing jig 521 after the drum grounding plate 70 is placed in the drum flange 50. As for the pressing jig 521, its diameter D53 equals the diameter D52 of the circle drawn by connecting the points at which the extensions 92*a*–92*h* are to be bent. The jig surface, which makes contact with the clamping plate 90 when pressing the clamping plate 90, is flat. Therefore, the springiness of the extensions 92*a*–92*h* of the clamping plate 90 is not adversely effected as the clamping plate 90 is pressed into the drum flange 50. The bosses 54*a*–54*h* fit into the holes 95*a*–95*h* of the clamping plate 90 as the clamping plate 90 is pressed into the drum flange 50.

After the attachment of the clamping plate 90, the bosses 54*a*–54*h* of the drum flange 50 are melted to permanently hold the drum grounding plate 70 and clamping plate 90 to the drum flange 50, completing the drum flange assembly 501.

The clamping plate 90 is attached to the drum flange 50 as described above. Then, the bosses 54*a*–54*h* of the drum flange 50 are melted, being positioned so that the cylinder clamping pawls 91*a*–91*h* are positioned on a line drawn through the midpoint between the adjacent two bosses and the center of the clamping plate 90.

As the drum grounding plate 70 is placed in the drum flange 50 in the above described manner, the tilted portion 76 of the drum grounding plate 70 engages with the rib 63 of the drum flange 50. More specifically, as the drum grounding plate 70 is placed in the drum flange 50, the tilted portion 76 comes in contact with the electrically conductive shaft 42*b*, and is pushed backward by the shaft 42*b*, coming in contact with the rib 63, while a certain amount of stress, or resilient pressure, is generated in the elastic arm portion 75. In this state, the tilted arm portion 76 is supported by the lateral surface of the rib 63.

Figure 17:
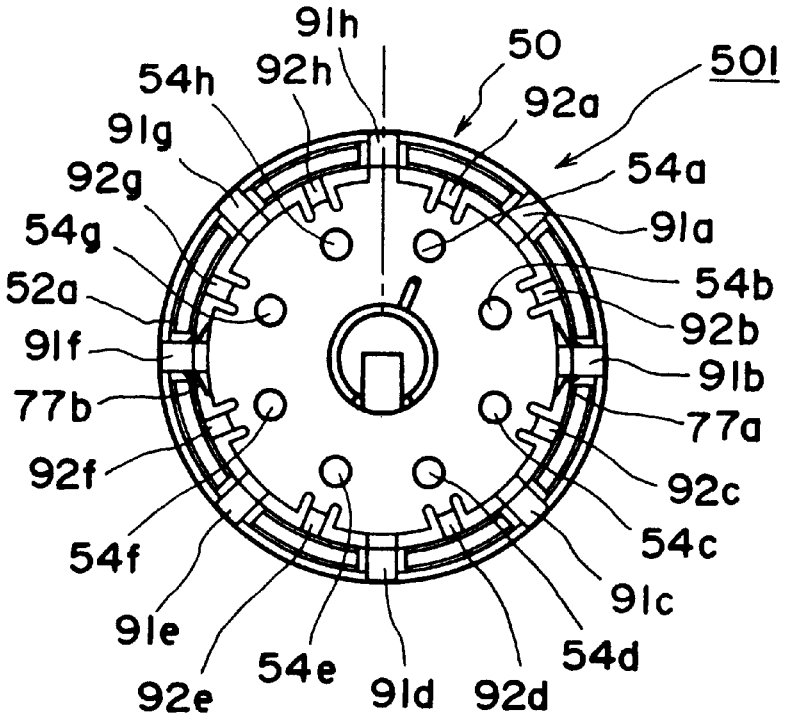
FIG. 17 is a front view of a drum flange.

FIG. 17 is a front view of the flange assembly 501, that is, the completed flange assembly 501, illustrated in FIG. 14, as seen from the side of bosses 54*a*–54*h*.

As illustrated in FIG. 17, the eight bosses 54*a*–54*h* of the drum flange 50 are aligned in a circle at the base portions of the drum flange clamping pawls 92*a*–92*h*, with the cylinder clamping pawls 91*a*–91*h* being positioned on the line drawn through the midpoint between the adjacent two bosses and the center of the clamping plate 90. More specifically, the thermally deformable bosses 54*a*–54*h* are aligned in a circle so that any adjacent two bosses are symmetrically positioned relative to the center line of a corresponding clamping extension. For example, the bosses 92*a* and 92*h* are symmetrically positioned relative to the center line 91*o* of the clamping extension 91*h*. Further, the bosses 54*a*–54*h* are aligned in a circle so that they do not align with extensions 91*a*–91*h* of the clamping plate 9 in the radial direction of the clamping plate 90, while adjacent two bosses are positioned symmetrically relative to the center line of the corresponding clamping extension.

Further, as depicted in FIG. 17, the springy arm portion 77*a* and 77*b* of the drum grounding plate 70, which are positioned symmetrically across the drum grounding plate 70, are held to the drum flange 50 by thermally deforming the pair of bosses 54*b* and 54*c* and the pair of bosses 54*f* and 54*g*. With this arrangement, the elastic arm portion 75 is firmly held down by the clamping plate 90, and therefore, the tilted elastic arm portion 75 is prevented from being pulled in the left or right direction, even though a certain amount of stress is generated in the elastic arm portions 77*a* and 77*b* when the drum flange assembly 501 is inserted into the photosensitive drum 7. Further, the contact point 75*a* of the drum grounding plate 70 makes contact with the center portion of the end of the electrically conductive shaft 42*b* (FIG. 4), and therefore, the wearing of the contact point 75*a* is minimized. Further, the flat portion 701 of the drum grounding plate 70 is firmly held to the drum flange 70 by the clamping plate 90, being prevented from deforming, and therefore, it is assured that the elastic arm portion 75 reliably generates a pressure of 50 g–100 g.

Further, according to the present invention, the number of the bosses of the drum flange 50 is eight, or the most appropriate number, so that the stress generated in the drum grounding plate 70 when the cylinder clamping pawls 91*a*–91*h* are pressed is borne by the drum flange clamping pawls 92*a*–92*h*, preventing thereby the bosses 54*a*–54*h* from being damaged.

In this embodiment, the drum flange 50 is provided with eight bosses 54*a*–54*h*. However, it may be provided with only two bosses. In such a case, the two bosses are symmetrically positioned relative to the longitudinal central axis of the photosensitive drum 7, and the clamping plate 90 is easily held to the drum flange 50 by melting the symmetrically positioned bosses.

Figure 18:
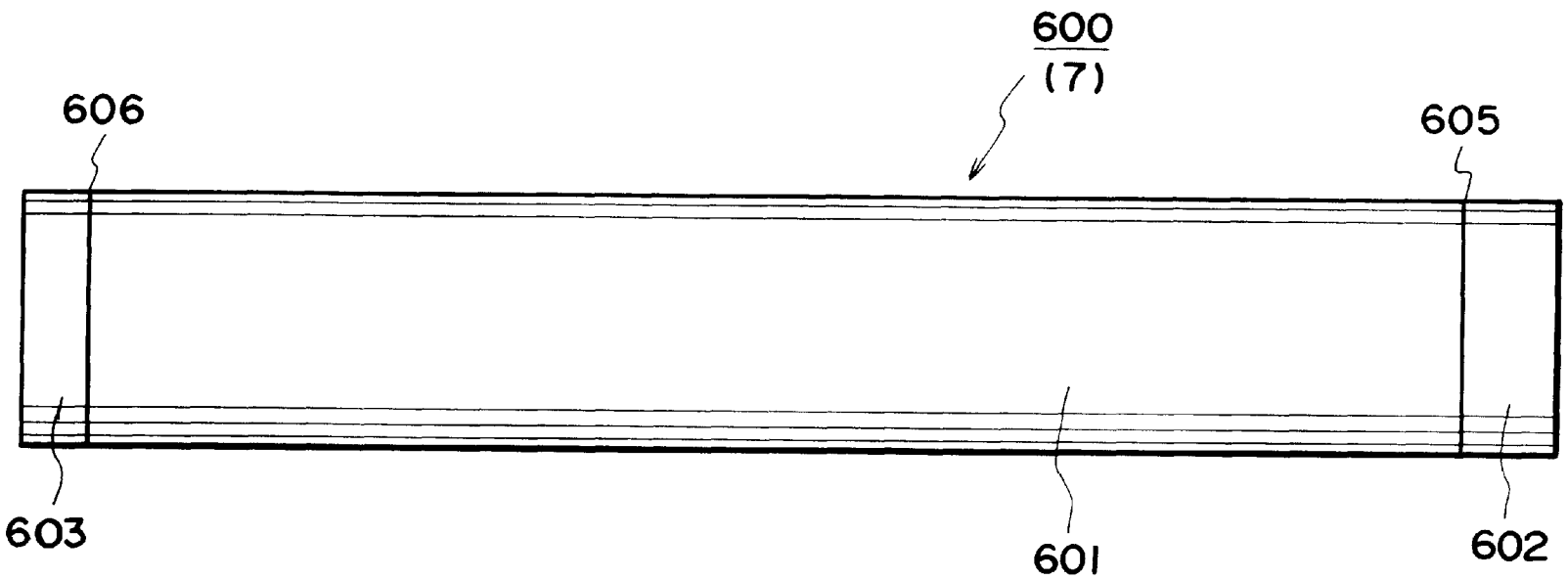
FIG. 18 is a front view showing a painted surface of the photosensitive drum.

FIG. 18 is a front view of the photosensitive drum 7, in particular, the coated peripheral surface thereof.

In FIG. 18, a reference character 600 designates a hollow aluminum cylinder which constitutes the base member of the photosensitive drum 7. The photosensitive layer is coated on the peripheral surface of this aluminum cylinder 600.

A reference character 601 designates the photosensitive layer portion (image bearing portion) on the aluminum cylinder 600, and reference characters 602 and 603 each designate a portion of the aluminum cylinder where the peripheral surface of the aluminum cylinder 600 is exposed.

One of the commonly used methods for coating the photosensitive drum 7 is as follows. The aluminum cylinder 600 is dipped in a pot (unillustrated) which contains melted photosensitive layer material, so that the aluminum cylinder 600 is dipped as deep as a line 605 between the coated and uncoated areas illustrated in FIG. 18. Then, the photosensitive material, having adhered to the inside surface of the aluminum cylinder 600, is removed by solvent, a blade (unillustrated), or the like.

Next, the photosensitive material having adhered to the outside of the aluminum cylinder 600 is removed from the end portion opposite to the end portion covered with the photosensitive material, up to the line 606 between the portion 603 and the photosensitive layer portion 601, by a blade or the like.

Hereinafter, a method for assembling the drum unit 7*b* will be described.

Figure 21:
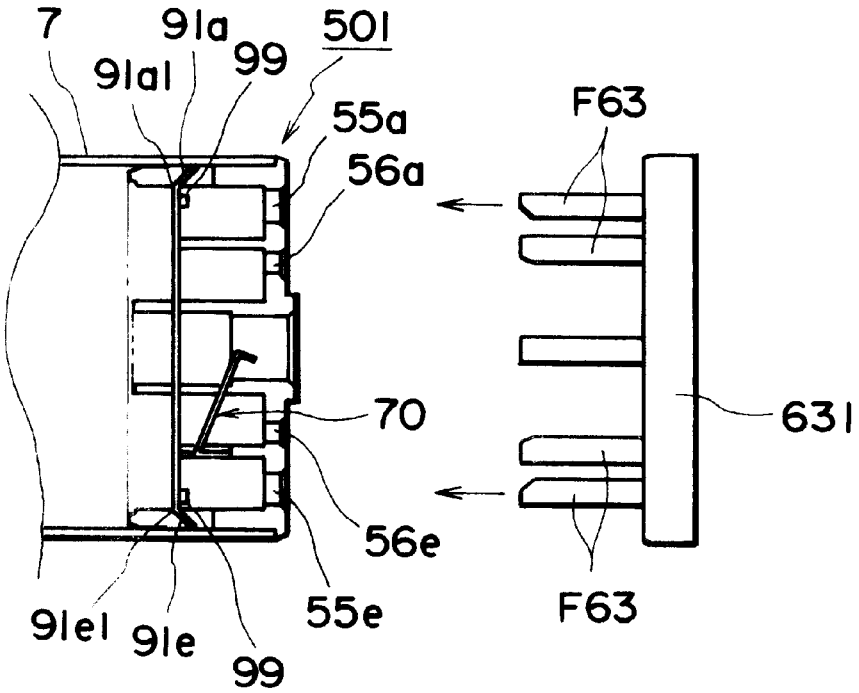
FIG. 21 is an illustration when a cylinder clamping pawl of a clamping plate is inserted by a pawl pushing tool.

The order in which the drum unit 7*b* is assembled is as follows. First, the drum flange assembly 501 is inserted into the photosensitive drum 7 (FIG. 21). Next, the cylinder clamping pawls 91*a*–91*h* of the clamping plate 90 are bent toward the center of the photosensitive drum 7 with the use of a pressing tool 631.

FIG. 19 is a drawing which shows the dimensional relationship between the drum flange assembly 501 and photosensitive drum 7.

The dimensional relationship between the internal diameter D707 of the photosensitive drum 7, and the measurements of the flange assembly 501 to be pressed into the photosensitive drum 7, is as follows. The external diameter D501 of the portion 51 of the drum flange 50 is 1.0005–1.005 times the internal diameter D707 of the photosensitive drum 7, and the external diameter D502 of the fitting portion 52 of the drum flange 50 is 0.999–1.002 times the internal diameter D707 of the photosensitive drum 7. The external diameter D503 of the fitting guide portion 53 of the drum flange 50 is perfectly matched with the internal diameter D707 of the photosensitive drum 7 so that the fitting guide portion 53 perfectly fits in the photosensitive drum 7, that is, without any gap.

The fitting portion 52 of the drum flange 50 is provided with an edge 52*b*, which is on the fitting guide portion 53 side of the drum flange 50 (FIG. 5).

The relationship among the external diameters D501, D502 and D503 of the fitting portions 51 and 52, and fitting guide portion 53, respectively, of the drum flange 50, and the internal diameter D707 of the photosensitive drum 7, in terms of the central value within a tolerance range is:

D501>D502>D707>D503.

Further, the external diameter D501 of the portion 51 of the drum flange 50 is definitely larger in terms of the central value in the tolerance range than the internal diameter D707 of the photosensitive drum 7.

The external diameter D503 of the fitting guide portion 53 is definitely smaller in terms of the central value in the tolerance range than the internal diameter D707 of the photosensitive drum 7.

The external diameter D502 of the portion 52 is larger than the internal diameter D707 of the photosensitive drum 7, only in terms of the central value within the tolerance range. Thus, some gap may be present between the portion 52 and the inside surface of the photosensitive drum 7 after the insertion of the drum flange 50 into the photosensitive drum 7. D5021 is an inner diameter of portion 52 (FIG. 19).

Figure 20:
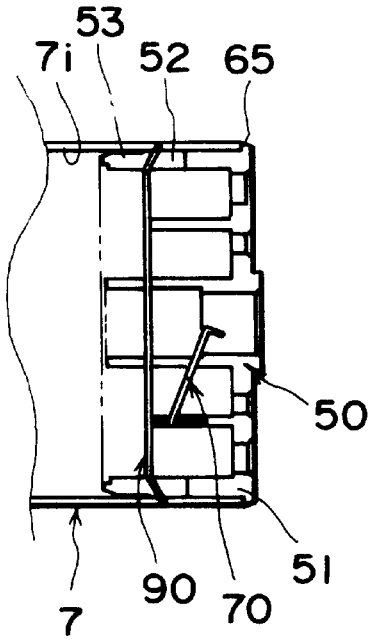
FIG. 20 shows the drum flange inserted into the photosensitive drum.

FIG. 20 is a sectional view of the drum flange assembly 501 after its insertion into the photosensitive drum 7.

In this embodiment, the drum flange assembly 502 complete with clamping plate 90 is inserted into the photosensitive drum 7, on the side 602 where the aluminum cylinder is exposed.

As the drum flange assembly 501 is inserted into the photosensitive drum 7, the insertion stopper 65 of the drum flange 50 functions to stop the insertion of the drum flange assembly 502, accurately positioning the drum flange assembly 502 relative to the photosensitive drum 7 in terms of the longitudinal direction of the photosensitive drum 7.

FIG. 21 is an-explanatory drawing which depicts how the cylinder clamping pawls 91*a*–91*h* of the clamping plate 90 are inserted into the photosensitive drum 7 up to the predetermined positions with the use of the pressing tool 631.

Figure 23:
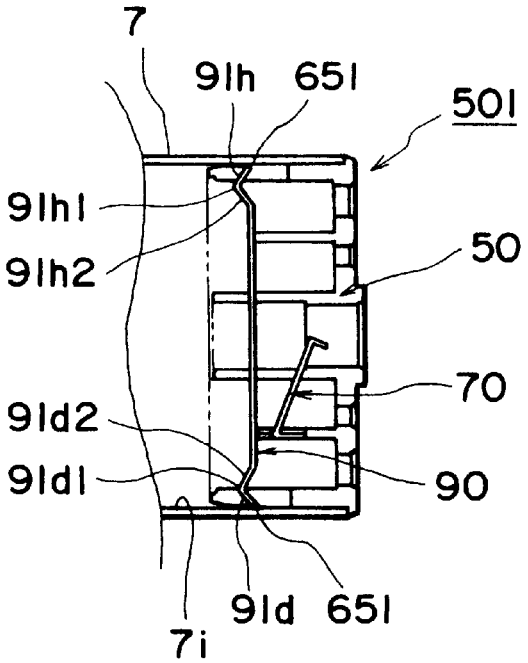
FIG. 23 is a sectional view of a drum flange mounted to the photosensitive drum 7.

The pressing tool 631 presses the cylinder clamping pawls 91*a*–91*h* of the clamping plate 90, on the pressure application points 99 located adjacent to the base portions of the extensions 91*a*–91*h*, by its pressing prongs F63, until the extensions 91*a*–91*h* settle in the positions illustrated in FIG. 23, at which they are caused to firmly grip the photosensitive drum 7. With the extensions 91*a*–91*h* settled in the positions illustrated in FIG. 23, the contact points 651 between the extensions 91*a*–91*h* and the photosensitive drum 7 are substantially the same as the location of the edge 52*a* of the fitting portion 52 of the drum flange 50. As the cylinder clamping pawl 91*a*–91*h* are pressed inward the photosensitive drum 7, the photosensitive material layer adhering to the inside surface of the photosensitive drum 7 is scraped away by them.

With the structure described above, the cylinder clamping pawls 91*a*–91*h* and the edge 52*a* of the fitting portion 52 of the drum flange 50 press upon the photosensitive drum 7 from inside, minimizing the loss of the circularity of the photosensitive drum 7 caused by the cylinder clamping pawls 91*a*–91*h*.

Further, the extensions 92*a*–92*h* are tilted toward the longitudinal center (inward) of the photosensitive drum 7 relative to the inside surface 52*b* of the fitting portion 52. Therefore, pressing the cylinder clamping pawls 91*a*–91*h* causes the drum clamping pawls 92*a*–92*h* to push the fitting portion 52 in the radially outward direction, creating a synergistic effect of preventing the circularity of the photosensitive drum 7 from being adversely affected.

Further, the extensions 91*a*–91*h* tilt outward of the photosensitive drum 7, that is, in the direction opposite to the extensions 92*a*–92*h*, in terms of the longitudinal direction of the photosensitive drum 7. Therefore, a synergistic effect is created also in terms of their resilient force generated by being elastically deformed, increasing thereby the force with which the extensions 91*a*–91*h* grip the photosensitive drum 7. In other words, the above described structure improves reliability.

Figure 22:
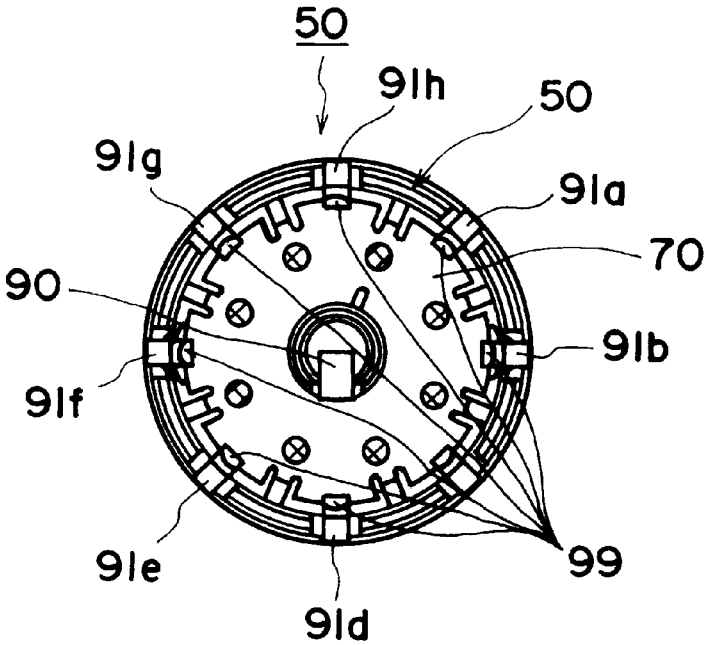
FIG. 22 shows a drum flange as seen from the center of the photosensitive drum toward outside.

FIG. 22 is a view of the drum flange assembly 501 as seen from the inward side of the photosensitive drum 7.

In FIG. 22, the pressing points 99 of the cylinder clamping pawls 91*a*–91*h* of the clamping pate 90, which are pressed by the pressing tool 631, are illustrated as if they are on the same plane as the plane of this drawing. The pressing prongs F63 of the pressing tool 631 press the back side (in this drawing) of the clamping plate 90 toward the longitudinal center of the photosensitive drum 7. The pressing points 99 are located at the approximate centers of the extensions 91*a*–91*h* in terms of the radial direction of the clamping plate 90, and outward of the circles drawn through the bosses 54*a*–54*h*, in terms of the radial direction of the clamping plate 90.

With the above arrangement, the extensions 91*a*–91*h* can be bent perpendicularly to the direction in which they are inserted. Therefore, the photosensitive drum 7 is better in circularity, and the drum flange assembly 501 is more reliably clamped to the photosensitive drum 7.

Further, as the clamping plate 90 is pressed by the pressing tool 631, on the pressing points 99, the cylinder clamping pawls 91*a*–91*h* are bent at points 91*a*2–91*h*2 (FIG. 23) which are adjacent to the original bent points 91*a*1–91*h*1 (FIG. 21).

FIG. 23 is a sectional view of the drum flange assembly 501 after its insertion into the photosensitive drum 7.

The cylinder clamping pawls 91*a*–91*h* of the clamping plate 90 contact the inside surface 7*i* of the photosensitive drum 7, at the points 651, being bent as illustrated in FIG. 23.

Figure 24:
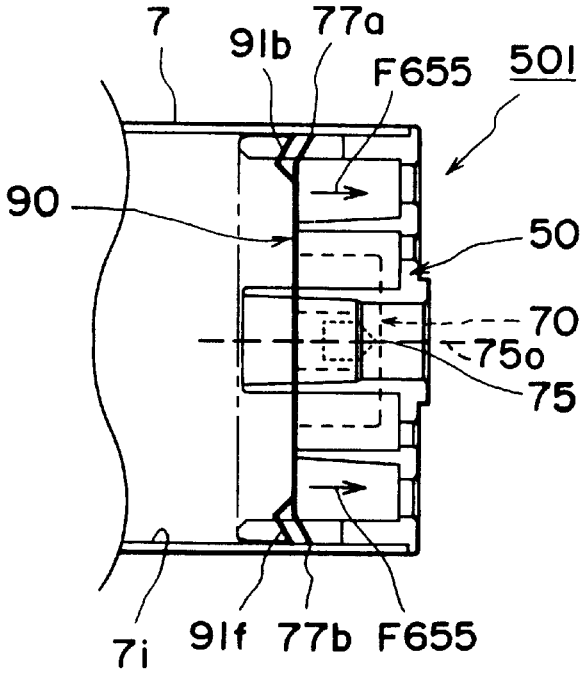
FIG. 24 shows a state in which a cylinder spring of a drum grounding plate is in the drum flange.

FIG. 24 shows a state in which a spring 77*a*(77*b*) of the grounding plate 70 is provided in the flange 501.

Since the spring 77*a*(77*b*) is provided with a through-hole 72 (unshown in FIG. 24), the force F655 of the spring 77*a*(77*b*) can be reduced. Therefore, the influence of the grounding plate 70 to the flat surface portion 701 can be reduced. In addition, the apparent width of the spring 77*a*(77*b*) can be enlarged, and therefore, it is not easily twisted, Accordingly, when it is inserted into the photosensitive drum 7, the spring 77*a*(77*b*) of the grounding plate 70 can maintain the surface(contact surface) of the second contact portion 73*a*(73*b*) at a perpendicular angle relative to the inserting direction. So, the edge surface of the contact portion 73*a*(73*b*) can be abutted to the inner wall 7*i* of the photosensitive drum 7.

Each side of the spring 77*a*(77*b*) is securely fixed by the boss 54*a*, 54*c*(54*f*, 54*g*). Therefore, the influence of the deformation of the spring 77*a*(77*b*) does not easily extend to the spring 75.

The springs 77*a* and 77*b* contacted to the inner wall 7*i* of the photosensitive drum 7 are provided at positions which are symmetrical relative to the center line 75*o* of the spring 75 contacted to the conduction shaft 42*b*. When the flange 501 is inserted for-mounting to the photosensitive drum 7, the deformation stress due to the contact of the springs 77*a* and 77*b* to the inner wall 7*i* of the photosensitive drum 7 can be balanced. Therefore, the deformation of the flat surface portion 701 can be prevented. By this, the stress applied to the spring 75 continuous with the flat surface portion 701 can be removed, and therefore, the spring 75 can be contacted to the center of the conduction shaft 42*b* assuredly.

Since the grounding plate 70 is covered with a clamping plate 90 having a flat surface portion 96, the grounding plate 70 can be firmly supported. Therefore, the spring 75 can be contacted to the center of the conduction shaft 42*b* with assurance, so that wearing thereof can be avoided.

Figure 25:
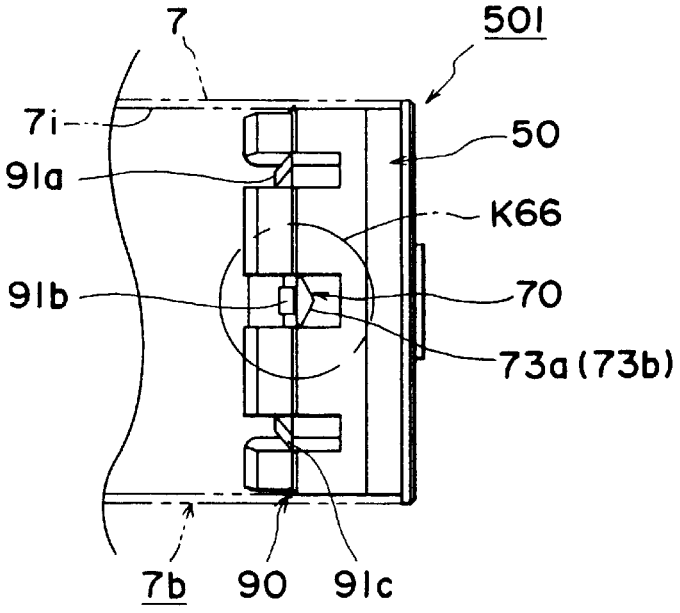
FIG. 25 is a side view showing a relation between the grounding plate and the cover member in a drum flange after it is assembled.

FIG. 25 is a side view showing a relation between the clamping plate 90 and the grounding plate 70 in a drum unit 7*b* after assembling. More particularly, the connecting portion between the flange 501 and the photosensitive drum 7 is seen through the photosensitive drum 7 after the drum unit 7*b* is assembled.

By pushing the tool 631 shown in FIG. 21, the pawls 91*a*–91*h* of the clamping plate 90 bite into the inner wall 7*i* of the photosensitive drum 7 at a position away from the contact portions 73*a*, 73*b* of the grounding plate 70.

Figure 26:
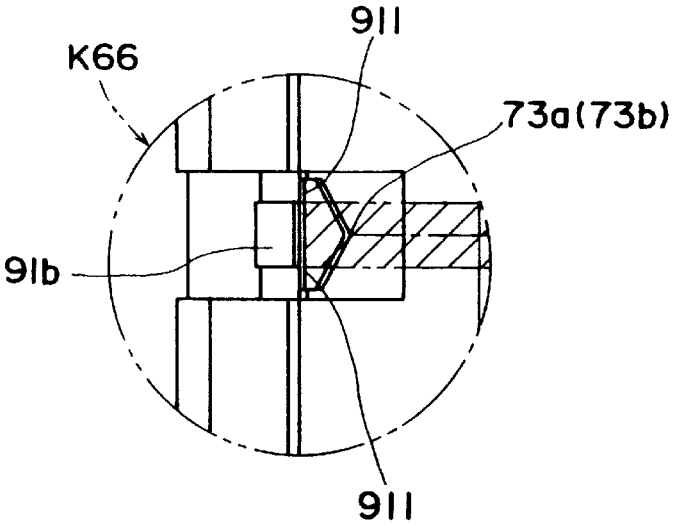
FIG. 26 illustrates in detail a relation between the cover member and the grounding plate.

FIG. 26 is a detailed illustration showing a relation between the grounding plate 70 and the clamping plate 90 shown in FIG. 25. More particularly, it is a detailed illustration of a portion indicated by K66 in FIG. 25.

As shown in FIG. 26, the pawls 91*a*–91*h* of the clamping plate 90 have a rectangular configuration at the free end portions, and therefore, the coating film of the photosensitive layer deposited on the inner wall 7*i* of the photosensitive drum 7 is scraped at the hatched lines region. By this, the second contact portion 73*a* (73*b*) can be further assuredly conducted to the metal surface of the photosensitive drum 7 at the peeled portion.

Since the clamping plate 90 is an electroconductive member, electric conduction is further assured by the rectangular edge portion 911 of the free end of each of the pawls 91*a*–91*h*. By pushing the pawls 91*a*–91*h*, the distance from the second contact portion 73*a* (73*b*) is increased, so that pawls 91*a*–91*h* further bite or wedge into the inner wall 7*i* of the photosensitive drum 7, and therefore, the electric conductivity is further assured. As described in the foregoing, according to the grounding plate 70 of this embodiment, the springs 77*a*, 77*b* contacted to the inner wall 7*i* of the photosensitive drum 7 are disposed symmetrically with respect to the center line 75*o* of the shaft contact spring 75 contacted to the conduction shaft 42*b*. Therefore, when the flange 501 is inserted into the photosensitive drum 7 to mount it, the deformation stress due to the deformation caused by contact of the springs 77*a*, 77*b* to the inner wall 7*i* (inside surface of the wall) of the photosensitive drum 7, can be balanced, and therefore, the deformation of the flat surface portion 701 can be prevented. By this, the stress applied to the spring 75 continuous with the flat surface portion 701 can be removed, and therefore, the spring 75 can be contacted to the center of the conduction shaft 42*b* assuredly. Therefore, the electroconductivity with the conduction shaft 42*b* is improved, and the quality of the drum unit 7*b* can be improved.

By bending the flat surface portion 701, the length of the spring 75 can be increased, and therefore, the spring constant can be reduced, by which the spring load can be applied to the conduction shaft 42*b* with stability, so that quality is improved in mass-production.

Two springs 77*a*, 77*b* are used, and they are disposed along a line perpendicular to the center line 75*o* of the spring 75. By this, when he flange 501 is inserted into the photosensitive drum 7 to mount it, the stress due to deformation caused by the contact of the springs 77*a*, 77*b* to the inner wall 7*i* of the photosensitive drum 7, can be reduced. The deformation of the flat surface portion 701 can be prevented, and therefore, the spring 75 can be assuredly contacted to the center of the conduction shaft 42*b*. In addition, the number of the springs 77*a*, 77*b* is a minimum (two), so that cost can be reduced.

By the provision of the through-holes 72*a*, 72*b* in the springs 77*a*, 77*b*, the spring force of the spring 77*a*, 77*b* can be reduced, and the cross-sectional size can be enlarged. Therefore, it is relatively rigid against the twisting. The part having the flash (stamping) of the grounding plate 70 can be assuredly contacted to the inner wall 7*i* of the photosensitive drum 7. By this, the conduction stability and the improvement of the quality can be accomplished.

Adjacent a base portion of each of the springs 77*a*, 77*b* of the flat surface portion 701, there are provided outside the width of the spring 77*a*, 77*b*, two boss holes 71*b*, 71*c*, 71*d*, 71*e* at positions symmetrical with respect to the center line 77*o*1, 77*o*2 of the spring 77*a*, 77*b*. The grounding plate 70 is fixed to the body 50 of the flange by bosses 54*b*, 54*c*, 54*f*, 54*g* through the boss holes 71*b*, 71*c*, 71*d*, 71*e*, sandwiching the springs 77*a*, 77*b*. By doing so, the springs 77*a*, 77*b* are relatively rigid against twisting. The part having the flash (stamping) of the grounding plate 70 can be assuredly contacted to the inner wall 7*i* of the photosensitive drum 7, and therefore, the conduction stability of the electrical contacts and the improvement of the quality can be accomplished.

At the opposite side, the grounding plate 70 is covered with a clamping plate 90, and the force applied to the grounding plate 70 is received by the flat surface portion 96 of the clamping-plate 90. The flat surface portion 701 which is the base of the spring 75 is enforced. By this, the deformation of the springs 77*a*, 77*b* due to the load to the springs 77*a*, 77*b* and the deformation of the shaft contact spring 75 due to the weight to the spring 75 upon insertion into the photosensitive drum 7, can be suppressed. The spring load of the spring 75 can be stably provided, and the improvement of the electroconductivity of the electrical contact and the improvement of the quality can be accomplished.

At the opposite side of the flat surface portion 701, the grounding plate 70 is fixed by the clamping plate 90, and the clamping plate 70 is provided with radial pawls 91*a*–91*h*. By this, when the flange 501 is inserted into the end where the aluminum metal is exposed (603), the pawls 91*a*–91*h* are slid in contact with the inner wall 7*i* of the photosensitive drum 7 along a circumferential line. By this, the inside coating layer is removed, and therefore, the electric contact between the photosensitive drum 7 and the grounding plate 70 is assured, so that the quality of the drum unit 7*b* can be improved.

The free ends of the springs 77*a*, 77*b* are triangular, and the free ends of the pawls 91*a*–91*h* of the clamping plate 90 are rectangular, so that the scraping function of the springs 77*a*, 77*b* and the pawls 91*a*–91*h* are assured. By this, the electric contact between the grounding plate and the photosensitive drum is assured. Therefore, the quality of the drum unit 7*b* is improved.

The pawls 91*a*–91*h* of the clamping plate 90 are elastically deformed toward the center (in the longitudinal direction) of the photosensitive drum 7, and are bent at bent portions 91*a*2–91*h*2. By this, the pawl 91*a*–91*h* bites or wedges into the inner wall 7*i* of the photosensitive drum 7. As a result, the flange 501 is urged toward the longitudinal center of the photosensitive drum 7. Therefore, the connection between the flange 501 and the photosensitive drum 7 is enhanced, and the quality of the drum unit 7*b* is improved.

By regulating the circumscribed circle of the pawls 91*a*–91*h* of the clamping plate 90 and limiting the length thereof, the mass-productivity of the clamping plate 90 can be improved.

After fitting of the flange 501 into the photosensitive drum 7, the pawls 91*a*–91*h* of the clamping plate 90 are further pressed through the through-holes 55*a*–55*h* of the disk 62 of the flange body 50, using a tool. By this, the pawls 91*a*–91*h* bite into the photosensitive drum 7, so that flange 501 is urged toward the center portion (in the longitudinal direction) of the photosensitive drum (toward inside). Therefore, the connection between the flange 501 and the photosensitive drum 7 are assured. Thus, the quality of the drum unit 7*b* is improved.

Since the number of the pawls 91*a*–91*h* of the clamping plate 90 is eight, the connection between the flange 501 and the photosensitive drum 7 is further assured. Thus, the quality of the drum unit 7*b* is improved.

Additionally, the pawls 91*a*–91*h* of the clamping plate 90 directly press against the inner wall 7*i* of the photosensitive drum 7, and they urge the photosensitive drum 7 by way of the inner wall 52*b* of the engaging portion 52 of the flange body 50. Therefore, the connection between the flange 501 and the photosensitive drum 7 is assured. Thus, the quality of the drum unit 7*b* is improved.

Additionally, the clamping plate 90 is electrically conductive, and the flat surface portion 701 of the grounding plate 70 and the flat surface portion 96 of the clamping plate 90 can be electrically conducted. After the flange 501 is fitted into the photosensitive drum 7, the pawls 91*a*–91*h* of the clamping plate 90 are further urged by the tool 631 through the through-hole formed in the disk 62 of the flange body 50. By this, the pawls 91*a*–91*h* wedge into the photosensitive drum 7, so that electric contact with the photosensitive drum 7 is further assured. Thus, the quality of the drum unit 7*b* is improved.

The clamping plate 90 is used as an electroconductive member, and the flat surface portion 96 of the clamping plate 90 is fixed to the flat surface portion 701 of the grounding plate 90 so that electric connection is established by the clamping plate 90. By doing so, the electric connection is improved, and the quality of the drum unit 7*b* can be improved.

(Other Embodiments)

Further, the process cartridge B in the first embodiment was of a type which formed a monochromatic image. However, the present invention is preferably applicable not only to a process cartridge which forms a monochromatic image, but also to a process cartridge which comprises multiple developing means and forms a multi-color image (for example, two-color image, three-color image, or full-color image).

Also, the electrophotographic photosensitive member is not limited to the photosensitive drum alone. For example, the following may be included. First, as for the photosensitive material, photoconductive material such as amorphous silicon, amorphous selenium, zinc oxide, titanium oxide, or organic photoconductive material may be included. As for the configuration of the base on which the photosensitive material is coated, a rotary configuration such as a drum shape, or a flat configuration such as a belt shape, may be included.

Also, the present invention is preferably usable with various known developing methods such as the magnetic brush developing method using two-component toner, the cascade-developing method, the touch-down developing method, and the cloud developing method.

The structure of the charging means has been described as a contact charging method, but a conventional structure is usable wherein a tungsten wire is enclosed by a metal shield of a material such as aluminum at three sides, and a high voltage is applied to the tungsten wire to generate positive or negative ions which are applied to the surface of the photosensitive drum, thus uniformly charging the surface of the drum.

Further, the charging means may be of a blade type (charge blade), a pad type, a block type, a rod type, or a wire type, in addition to the aforementioned roller type.

The means for cleaning the toner remaining on the photosensitive drum may be of a blade type, a fur brush type, a magnetic brush type, or the like.

In the description of the embodiments, the laser beam printer is taken, but the present invention is not limited to this, and is usable with an electrophotographic copying machine, a facsimile machine, a word processor or another electrophotographic image forming apparatus.

As described in the foregoing, according to the grounding member of the present invention, the contact to the inner wall of the cylindrical member is stabilized, and the contact to the conduction shaft is stabilized.

While the invention has been described with reference to the structures disclosed herein, it is not confined to the details set forth and this application is intended to cover such modifications or changes as may come within the purposes of the improvements or the scope of the following claims.

What is claimed is:

1. An electrical grounding member for an electrophotographic photosensitive drum, comprising:

a base plate;

a hole, formed in said base plate, for receiving a conduction shaft for supporting the electrophotographic photosensitive drum;

a first contact portion provided in said base plate and elastically contactable to the conduction shaft;

a second contact portion, provided in said base plate, elastically contactable an inner surface of a cylinder of the electrophotographic photosensitive drum; and a third contact portion, provided in said base plate, elastically contactable to an inner surface of the cylinder of the electrophotographic photosensitive drum, wherein said second contact portion and third contact portion are disposed at symmetrical positions relative to each other with respect to a center line of a contact portion between said first contact portion and the conduction shaft, and wherein said second contact portion and said third contact portion include leaf springs which are provided with holes.

2. A grounding member according to claim 1, wherein said first contact portion includes a leaf spring which is bent away from a central portion of the electrophotographic photosensitive drum in a longitudinal direction of the electrophotographic photosensitive drum.

3. A grounding member according to claim 1 or 2, wherein a line connecting said second contact portion and third contact portion is substantially perpendicular to a center line of a contact portion between said first contact portion and the conduction shaft, and wherein said second contact portion and third contact portion are projected outwardly from an edge of said base plate.

4. A grounding member according to claim 3, wherein said grounding member has holes at positions symmetrical relative to each other with respect to a center line of said second contact portion and third contact portion, and spaced by a distance which is larger than a width of said second contact portion or a width of said third contact portion.

5. A grounding member according to claim 1, wherein the conduction shaft supports the electrophotographic photosensitive drum on a supporting member, and wherein the supporting member is a process cartridge.

6. A grounding member according to claim 1, wherein each of the first, second and third contact portions is composed of a metal material, the first contact portion includes a leaf spring aligned in a predetermined direction and bent away from the central portion of the electrophotographic photosensitive drum in a longitudinal direction of the electrophotographic photosensitive drum, a line connecting the second contact portion and the third contact portion is substantially perpendicular to a center line of a contact portion between said first contact portion ans the conduction shaft, the second contact portion and the third contact portion projecting outwardly from an edge of the base plate, the grounding member has apertures at positions symmetrical relative to each other with respect to a center line of the second contact portion and the third contact portion, and spaced by a distance which is larger than a width of the second contact portion or a width of the third contact portion, and the grounding member is fixed to a circular member that has an engaging portion for engagement with an inner surface of the electrophotographic photosensitive drum when the cirular member is mounted to the electrophotographic photosensitive drum which side includes an aperture for receiving the conduction shaft, and the conduction shaft supports the electrophotographic photosensitive drum on a process cartridge.

7. A drum flange mountable to an end of a cylinder of an electrophotographic photosensitive drum, comprising:

a. a circular member having an engaging portion for engagement with the end of the cylinder; and b. an electrical grounding member, which includes:

a base plate;

a hole, formed in said base plate, for receiving a conduction shaft for supporting the electrophotographic photosensitive drum;

a first contact portion provided in said base plate and elastically contactable to said conduction shaft;

a second contact portion, provided in said base plate, elastically contactable to an inner surface of the cylinder of the electrophotographic photosensitive drum; and a third contact portion, provided in said base plate, elastically contactable to an inner surface of the cylinder of the electrophotographic photosensitive drum, wherein said second contact portion and third contact portion are disposed at symmetrical positions relative to each other with respect to a center line of a contact portion between said first contact portion and the conduction shaft, and wherein said second contact portion and said third contact portion include leaf springs which are provided with holes.

8. A drum flange according to claim 7, wherein said circular member has an engaging portion for engagement with an inner surface of the cylinder when said flange is mounted to said cylinder, and wherein said engaging portion is provided with a hole for receiving the conduction shaft.

9. A drum flange according to claim 7 or 8, wherein said first, second, and third contact portions are composed of metal material.

10. A drum flange according to claim 7 or 8, wherein a line connecting said second contact portion and third contact portion is substantially perpendicular to a center line of a contact portion between said first contact portion and the conduction shaft, and wherein said second contact portion and third contact portion are projected outwardly from an edge of said base plate.

11. A drum flange according to claim 10, wherein said electrical grounding member include holes at positions symmetrical relative to each other with respect to a center line of said second contact portion and third contact portion, and spaced by a distance which is larger than a width of said second contact portion or a width of said third contact portion.

12. A drum flange according to claim 6, wherein the supporting member is a process cartridge.

13. A drum flange according to claim 7, wherein the conduction shaft supports the electrophotographic photosensitive drum on a supporting member, and wherein the supporting member is a process cartridge.

14. A drum flange according to claim 7, wherein each of the first, second and third contact portions is composed of a metal material, the circular member includes an engaging portion for engagement with an inner surface of the cylinder when said flange is mounted to the cylinder, the side being provided with an aperture for receiving the conduction shaft, the first contact portion includes a leaf spring aligned in a predetermined direction and bent away from a central portion of the electrophotographic photosensitive drum in a longitudinal direction of the electrophotographic photosensitive drum, a line connecting the second and third contact portions is substantially perpendicular to the center line of the contact portion between the first contact portion and the conduction shaft, and the second and third contact portions project outwardly from an edge of said base plate, the electrical grounding member further includes apertures at positions symmetrical relative to each other with respect to a center line of the second and third contact portions and spaced by a distance larger than a width of the second contact portion or a width of the third contact portion, and the conduction shaft supports the electrophotographic photosensitive drum on a process cartridge.

15. An electrophotographic photosensitive drum for an electrophotographic image forming apparatus, comprising:

a. a cylinder provided with a photosensitive layer thereon; and b. a drum flange, said drum flange including;

a circular member having an engaging portion for engagement with the end of the cylinder; and an electrical grounding member, which includes:

a base plate;

a hole, formed in said base plate, for receiving a conduction shaft for supporting the electrophotographic photosensitive drum;

a first contact portion provided in said base plate and elastically contactable to the conduction shaft;

a second contact portion, provided in said base plate, elastically contactable to an inner surface of a cylinder of the electrophotographic photosensitive drum; and a third contact portion, provided in said base plate, elastically contactable to an inner surface of the cylinder of the electrophotographic photosensitive drum, wherein said second contact portion and third contact portion are disposed at symmetrical positions relative to each other with respect to a center line of a contact portion between said first contact portion and the conduction shaft, and wherein said second contact portion and third contact portion include leaf springs which are provided with holes.

16. A drum according to claim 15, wherein said circular member has an engaging portion for engagement with an inner surface of the cylinder when said flange is mounted to said cylinder, and wherein said engaging portion is provided with a hole for receiving the conduction shaft.

17. A drum according to claim 15 or 16, wherein said first, second and third contact portions are composed of metal material.

18. A drum according to claim 15 or 16, wherein a line connecting said second contact portion and third contact portion is substantially perpendicular to a center line of a contact portion between said first contact portion and the conduction shaft, and wherein said second contact portion and third contact portion are projected outwardly from an edge of said base plate.

19. A drum according to claim 18, wherein said electrical grounding member includes holes at positions symmetrical relative to each other with respect to a center line of said second contact portion and third contact portion, and spaced by a distance which is larger than a width of said second contact portion or a width of said third contact portion.

20. A drum according to claim 15, wherein said first contact portion includes a leaf spring which is bent away from a central portion of the electrophotographic photosensitive drum in a longitudinal direction of the electrophotographic photosensitive drum.

21. A drum according to claim 15, wherein the conduction shaft supports the electrophotographic photosensitive drum on a supporting member, and wherein the supporting member is a process cartridge.

22. A drum according to claim 15, wherein the first, second and third contact portions are composed of metal material, the circular member includes an engaging portion for engagement with an inner surface of the cylinger when the flange is mounted to the cylinder, the side being provided with an aperture for receiving the conduction shaft, the first contact portion includes a leaf spring aligned in a predetermined direction and bent away from a central portion of the electrophotographic photosensitive drum in a longitudinal direction of the electrophotographic photosensitive drum, a line connecting the second and third contact portions is substantially perpendicular to the center line of the contact portion between the first contact portion and the conduction shaft, the second and third contact portions project outwardly from an edge of said base plate, the electrical grounding member further includes apertures at positions symmetrical relative to each other with respect to a center line of the second and third contact portions and spaced by a distance larger than a width of the second contact portion or a width of the third contact portion, and the conduction shaft supports the electrophotographic photosensitive drum on a process cartridge.

23. A process cartridge detachably mountable relative to a main assembly of an electrophotographic image forming apparatus, said process cartridge comprising:

a. an electrophotographic photosensitive drum, which includes:

a cylinder provided with a photosensitive layer thereon; and a drum flange, said drum flange including:

a circular member having an engaging portion for engagement with an end of the cylinder; and an electrical grounding member, which includes:

a base plate;

a hole, formed in said base plate, for receiving a conduction shaft for supporting the electrophotographic photosensitive drum;

a first contact portion provided in said base plate and elastically contactable to said conduction shaft;

a second contact portion, provided in said base plate, elastically contactable to an inner surface of the cylinder of the electrophotographic photosensitive drum; and a third contact portion, provided in said base plate, elastically contactable to an inner surface of the cylinder of the electrophotographic photosensitive drum, wherein said second contact portion and third contact portion are disposed at symmetrical positions relative to each other with respect to a center line of a contact portion between said first contact portion and the conduction shaft, and wherein said second contact portion and third contact portion include leaf springs which are provided with holes; and b. process means actable on the electrophotographic photosensitive drum.

24. A process cartridge according to claim 21 or 23, wherein a line connecting said second contact portion and third contact portion is substantially perpendicular to the center line of the contact portion between said first contact portion and the drum shaft, and wherein said second contact portion and third contact portion are projected outwardly from an edge of said base plate.

25. A process cartridge according to claim 24, wherein said grounding member includes holes at positions symmetrical relative to each other with respect to a center line of said second contact portion and third contact portion, and spaced by a distance which is larger than a width of said second contact portion and third contact portion.

26. A process cartridge according to claim 20, wherein said circular member has a side which is opposed to a side surface of said cylinder when said flange is mounted to said cylinder, and wherein said side is provided with a hole for receiving the drum shaft.

27. A process cartridge according to claim 24 or 26, wherein a line connecting said second contact portion and third contact portion is substantially perpendicular to the center line of a contact portion between said first contact portion and the conduction shaft, and wherein said second contact portion and third contact portion are projected outwardly from an edge of said base plate.

28. A process cartridge according to claim 27, wherein said grounding member includes holes at positions symmetrical relative to each other with respect to a center line of said second contact portion and third contact portion, and spaced by a distance which is larger than a width of said second contact portion or a width of said third contact portion.

29. A drum according to claim 23, wherein said circular member has an engaging portion for engagement with an inner surface of the cylinder when said flange is mounted to said cylinder, and wherein said engaging portion is provided with a hole for receiving the conduction shaft.

30. A process cartridge according to claim 23, wherein first, second and third contact portions are composed of metal material, the circular member includes an engaging portion for engagement with an inner surface opposed to a side surface of the cylinger when said flange is mounted to the cylinder, the side being provided with an aperture for receiving the conduction shaft, the first contact portion includes a leaf spring aligned in a predetermined direction and bent away from a central portion of the electrophotographic photosensitive drum in a longitudinal direction of the electrophotographic photosensitive drum, a line connecting the second and third contact portions is substantially perpendicular to the center line of the contact portion between the first contact portion and the conduction shaft, the second and third contact portions projecting outwardly from an edge of the base plate, and the grounding member includes apertures at positions symmetrical relative to each other with respect to a center line of the second and third contact portions and spaced by a distance which is larger than a width of said second contact portion or a width of the third contact portion.

31. An electrophotographic image forming apparatus for forming an image on a recording material, to which a process cartridge is detachably mountable, said apparatus comprising:

a. a mounting member for detachably mounting a process cartridge, said process cartridge including:

an electrophotographic photosensitive drum, said drum including:

a cylinder provided with a photosensitive layer thereon; and a drum flange said drum flange including:

a circular member having an engaging portion for engagement with an end of said cylinder, and an electrically grounding member for electrically grounding the process cartridge to the main assembly of the electrophotographic image forming apparatus when said process cartridge is mounted to the main assembly of the apparatus, said grounding member including:

a base plate;

a first contact portion provided in said base plate and elastically contactable to the conduction shaft;

a second contact portion, provided in said base plate, elastically contactable to an inner surface of a cylinder of the electrophotographic photosensitive drum; and a third contact portion, provided in said base plate, elastically contactable to the inner surface of the cylinder of the electrophotographic photosensitive drum, wherein said second contact portion and third contact portion are disposed at symmetrical positions relative to each other with respect to a center line of a contact portion between said first contact portion and the conduction shafts, and wherein said second contact portion and said third contact portion include leaf springs which are provided with holes; and process means actable on the electrophotographic photosensitive drum;

b. a feeding member for feeding the recording material; and c. a main assembly side grounding contact for electrical connection with said grounding member of said process cartridge when said process cartridge is mounted to the main assembly.

32. An electrophotographic image forming apparatus according to claim 31, wherein the first, second and third contact portions are composed of metal material, the circular member includes an engaging portion for engagement with an inner surface which opposes a side surface of the cylinger when said flange is mounted to the cylinder, the side being provided with an aperture for receiving the conduction shaft, the first contact portion includes a leaf spring aligned in a predetermined direction and bent away from a central portion of the electrophotographic photosensitive drum in a longitudinal direction of the electrophotographic photosensitive drum, a line connecting the second and third contact portions is substantially perpendicular to the center line of the contact portion between the first contact portion and the conduction shaft, the second and third contact portions projecting outwardly from an edge of said base plate, and the grounding member includes apertures at positions symmetrical relative to each other with respect to a center line of said second and third contact portions and spaced by a distance which is larger than a width of the second contact portion or a width of the third contact portion.

* * * * *

UNITED STATES PATENT AND TRADEMARK OFFICE

CERTIFICATE OF CORRECTION

PATENT NO. : 6,167,219
DATED : December 26, 2000
INVENTOR(S) : Jun Miyamoto et al.

It is certified that error appears in the above-identified patent and that said Letters Patent is hereby corrected as shown below:

Title page,
Item [57], ABSTRACT,
Line 2, “hole” should read -- hole, --.

Column 2,
Line 13, “wherein” should read -- wherein the --.

Column 9,
Line 30, “of SUS” should read -- of an SUS --.

Column 16,
Line 5, “he” should read -- the --.

Column 18,
Line 45, “an” should read -- to an --.

Column 19,
Line 24, “ans” should read -- and --.
Line 32, “and the” should read -- and ¶ the --.
Line 35, “cirular” should read -- circular --.

Column 20,
Delete line 23 and 24.

Column 21,
Line 53, “cylinger” should read -- cylinder --.

Column 22,
Replace lines 46-52 with -- Claim 23. A process cartridge according to Claim 22, wherein said process means includes at least one of a charging member for electrically charging the electrophotographic photosensitive drum, a developing member for developing an electrostatic latent image formed on said electrophotographic photosensitive drum and a cleaning member for removing toner remaining on the electrophotographic photosensitive drum. --.

UNITED STATES PATENT AND TRADEMARK OFFICE

CERTIFICATE OF CORRECTION

PATENT NO. : 6,167,219
DATED : December 26, 2000
INVENTOR(S) : Jun Miyamoto et al.

It is certified that error appears in the above-identified patent and that said Letters Patent is hereby corrected as shown below:

Column 22 contd.,
Replace lines 53-58, with the following: -- Claim 24. A process cartridge according to claim 23, wherein said first, second, and third contact portions are of metal material --.
Replace lines 59-63, with the following: -- Claim 25. A process cartridge according to Claim 23, wherein said first contact portion includes a leaf spring which is bent away from a central portion of the electrophotographic photosensitive drum in a longitudinal direction of the electrophotographic photosensitive drum. --.

Column 23,
Line 20, "surface" should read -- side --.

Column 24,
Line 17, "shafts," should read -- shaft --.

Signed and Sealed this

Eighteenth Day of June, 2002

*Attest:*

*Attesting Officer*

JAMES E. ROGAN
*Director of the United States Patent and Trademark Office*